US011423846B2

(12) United States Patent
Yoon et al.

(10) Patent No.: US 11,423,846 B2
(45) Date of Patent: Aug. 23, 2022

(54) DISPLAY DEVICE AND DRIVING METHOD THEREOF

(71) Applicant: Samsung Display Co., Ltd., Yongin-Si (KR)

(72) Inventors: Changnoh Yoon, Seoul (KR); Sangan Kwon, Cheonan-si (KR); Soon-Dong Kim, Osan-si (KR); Taehoon Kim, Hwaseong-si (KR); Hui Nam, Suwon-si (KR); Eun Sil Yun, Hwaseong-si (KR); Seungjae Lee, Suwon-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/240,111

(22) Filed: Apr. 26, 2021

(65) Prior Publication Data

US 2022/0068216 A1 Mar. 3, 2022

(30) Foreign Application Priority Data

Sep. 2, 2020 (KR) ..... 10-2020-0111936

(51) Int. Cl.
*G09G 3/3275* (2016.01)
*G09G 3/3266* (2016.01)

(52) U.S. Cl.
CPC ..... *G09G 3/3275* (2013.01); *G09G 3/3266* (2013.01); *G09G 2320/0233* (2013.01); *G09G 2320/103* (2013.01)

(58) Field of Classification Search
CPC ..... G06F 1/3203; G06F 1/3206; G06F 1/324; G06F 1/3218; G06F 1/3265; G06F 1/3262; G06F 3/04886; G09G 3/3275; G09G 3/3266; G09G 2310/04; G09G 2310/08; G09G 2320/10; G09G 2320/103; G09G 2320/106; G09G 2320/02; G09G 2320/0233; G09G 2320/0238;
(Continued)

(56) References Cited

U.S. PATENT DOCUMENTS 9,548,016 B2 1/2017 Lee et al.
10,656,743 B2 5/2020 Park et al.
(Continued)

FOREIGN PATENT DOCUMENTS

KR 1020160011818 A 2/2016
KR 1020190058995 A 5/2019
(Continued)

*Primary Examiner* — Nitin Patel
*Assistant Examiner* — Amen W Bogale
(74) *Attorney, Agent, or Firm* — Cantor Colburn LLP

(57) ABSTRACT

A display device includes a display panel, a data driving circuit which drives a plurality of data lines, a scan driving circuit which drives a plurality of scan lines, and a driving controller which controls the data driving circuit and the scan driving circuit such that the display panel is divided into a first display region and a second display region during a multi-frequency mode and the first display region and the second display region are respectively operated at different frequencies, where the driving controller changes an operation mode to a normal mode when a still image and a moving image are simultaneously displayed in the first display region during the multi-frequency mode and the duration of the still image reaches a predetermined time.

22 Claims, 20 Drawing Sheets

(58) Field of Classification Search
CPC ... G09G 2320/0686; G09G 2320/0247; G09G 2330/021; G09G 2340/0435
See application file for complete search history.

(56) References Cited

U.S. PATENT DOCUMENTS

| | | | | |
|---|---|---|---|---|
| 2014/0085276 | A1 | 3/2014 | Jang et al. | |
| 2014/0092145 | A1 | 4/2014 | Park et al. | |
| 2014/0375627 | A1 | 12/2014 | Kim et al. | |
| 2016/0042708 | A1 | 2/2016 | Wang et al. | |
| 2016/0111055 | A1* | 4/2016 | Na | G09G 3/3666 345/94 |
| 2020/0051492 | A1* | 2/2020 | Chen | G09G 3/20 |

FOREIGN PATENT DOCUMENTS

| | | | |
|---|---|---|---|
| KR | 102070218 | B1 | 1/2020 |
| KR | 1020200015645 | A | 2/2020 |

* cited by examiner

DISPLAY DEVICE AND DRIVING METHOD THEREOF

This application claims priority to Korean Patent Application No. 10-2020-0111936, filed on Sep. 2, 2020, and all the benefits accruing therefrom under 35 U.S.C. § 119, the content of which in its entirety is herein incorporated by reference.

BACKGROUND

1. Field

Embodiments of the invention herein relate to a display device.

2. Description of the Related Art

Among display devices, an organic light emitting display device displays an image using an organic light emitting diode which generates light by recombination of electrons and holes. The organic light emitting display device has advantages of having fast response speed and being driven with low power consumption, for example.

An organic light emitting display device is provided with pixels connected to data lines and scan lines. The pixels usually include an organic light emitting diode and a circuit for controlling an amount of current flowing into the organic light emitting diode. The circuit controls the amount of current flowing from a first driving voltage to a second driving voltage via the organic light emitting diode in correspondence to a data signal. At this time, in correspondence to the amount of the current flowing through the organic light emitting diode, light with a predetermined luminance is generated.

Recently, a display device is used in various fields. Therefore, a plurality of different images may be simultaneously displayed on a single display device. In this regard, there is a demand for a technology capable of preventing display quality degradation while reducing the power consumption of a display device on which a plurality of images is simultaneously displayed.

SUMMARY

Embodiments of the invention herein provide a display device capable of reducing power consumption and preventing display quality degradation, and a driving method thereof.

An embodiment of the invention provides a display device including a display panel including a plurality of pixels respectively connected to corresponding data lines of a plurality of data lines and corresponding scan lines of a plurality of scan lines, a data driving circuit which drives the plurality of data lines, a scan driving circuit which drives the plurality of scan lines, and a driving controller which controls the data driving circuit and the scan driving circuit such that the display panel is divided into a first display region and a second display region during a multi-frequency mode, and the first display region and the second display region are respectively operated at different frequencies. In an embodiment, the driving controller may change an operation mode to a normal mode when a still image and a moving image are simultaneously displayed in the first display region during the multi-frequency mode and a duration of the still image reaches a predetermined time.

In an embodiment, the first display region may be driven at a first driving frequency and the second display region may be driven at a second driving frequency lower than the first driving frequency during the multi-frequency mode.

In an embodiment, each of the first display region and the second display region may be driven at a normal frequency during the normal mode.

In an embodiment, the first driving frequency may be identical to the normal frequency.

In an embodiment, the driving controller may include a frequency mode determination part which determines the operation mode based on an image signal and a control signal and outputs a mode signal and a signal generator which outputs a data control signal and a scan control signal corresponding to the mode signal, where the data control signal may be provided to the data driving circuit, and the scan control signal may be provided to the scan driving circuit.

In an embodiment, the frequency mode determination part may change the operation mode such that the mode signal represents the normal mode when the still image and the moving image are simultaneously displayed in the first display region during the multi-frequency mode and the duration of the still image reaches a predetermined time.

In an embodiment, the frequency mode determination part may change the operation mode such that the mode signal represents the normal mode when an average luminance of the still image displayed in the first display region is higher than a reference luminance.

In an embodiment, the frequency mode determination part may change the operation mode such that the mode signal represents the normal mode when the average luminance of the still image displayed in the first display region is higher than a reference luminance and the duration of the still image reaches the predetermined time.

In an embodiment, the frequency mode determination part may change the operation mode such that the mode signal represents the normal mode when the still image displayed in the first display region is a worst pattern and the duration of the still image reaches the predetermined time.

In an embodiment, the frequency mode determination part may change the operation mode such that the mode signal represents the normal mode according to the duration of the still image when the still image displayed in the first display region is a worst pattern and a display area of the still image is greater than a reference area.

In an embodiment, the frequency mode determination part may change the frequency of the second display region to a first intermediate frequency when the duration of the still image reaches a first reference time, and may change the frequency of the second display region to a second intermediate frequency when the duration of the still image reaches a second reference time, where the second reference time may be greater than the first reference time, and the second intermediate frequency may be higher than the first intermediate frequency.

In an embodiment, the frequency mode determination part may change the operation mode such that the mode signal represents the normal mode when the duration of the still image reaches a third reference time, where the third reference time may be greater than the second reference time.

In an embodiment, the frequency mode determination part may determine that the display area of the still image is greater than the reference area when a ratio of a length of the still image in a first direction to a length of the first display region in the first direction is equal to or greater than a predetermined value.

In an embodiment of the invention, a method for driving a display device includes dividing a display panel into a first display region and a second display region during a multi-frequency mode, driving the first display region at a first driving frequency and driving the second display region at a second driving frequency, determining whether a still image and a moving image are simultaneously displayed in the first display region, and changing an operation mode to a normal mode when a duration of the still image reaches a predetermined time.

In an embodiment, the method may further include changing the operation mode to the normal mode when an average luminance of the still image displayed in the first display region is higher than a reference luminance.

In an embodiment, the changing the operation mode to the normal mode may include determining whether the average luminance of the still image displayed in the first display region is higher than a reference luminance, and changing the operation mode to the normal mode when the average luminance of the still image is higher than the reference luminance and the duration of the still image reaches the predetermined time.

In an embodiment, the changing the operation mode to the normal mode may include determining whether the still image displayed in the first display region is a worst pattern, and changing the operation mode to the normal mode when the still image is the worst pattern and the duration of the still image reaches the predetermined time.

In an embodiment, the changing the operation mode to the normal mode may include determining whether the still image displayed in the first display region is a worst pattern, determining whether the display area of the still image is greater than a reference area, and changing the second driving frequency according to the duration of the still image when the still image displayed in the first display region is the worst pattern and the display area of the still image is greater than the reference area.

In an embodiment, the changing the second driving frequency may include changing the second driving frequency to a first intermediate frequency when the duration of the still image reaches a first reference time, and changing the second driving frequency to a second intermediate frequency when the duration of the still image reaches a second reference time, where the second reference time may be greater than the first reference time, and the second intermediate frequency may be higher than the first intermediate frequency.

In an embodiment, the changing the operation mode to the normal mode may include changing the operation mode to the normal mode when the duration of the still image reaches a third reference time, where the third reference time may be greater than the second reference time.

In an embodiment, the changing the second driving frequency may determine that the display area of the still image is greater than the reference area when a ratio of a length of the still image in a first direction to a length of the first display region in the first direction is equal to or greater than a predetermined value.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain principles of the invention. In the drawings.

DETAILED DESCRIPTION

Figure 1:
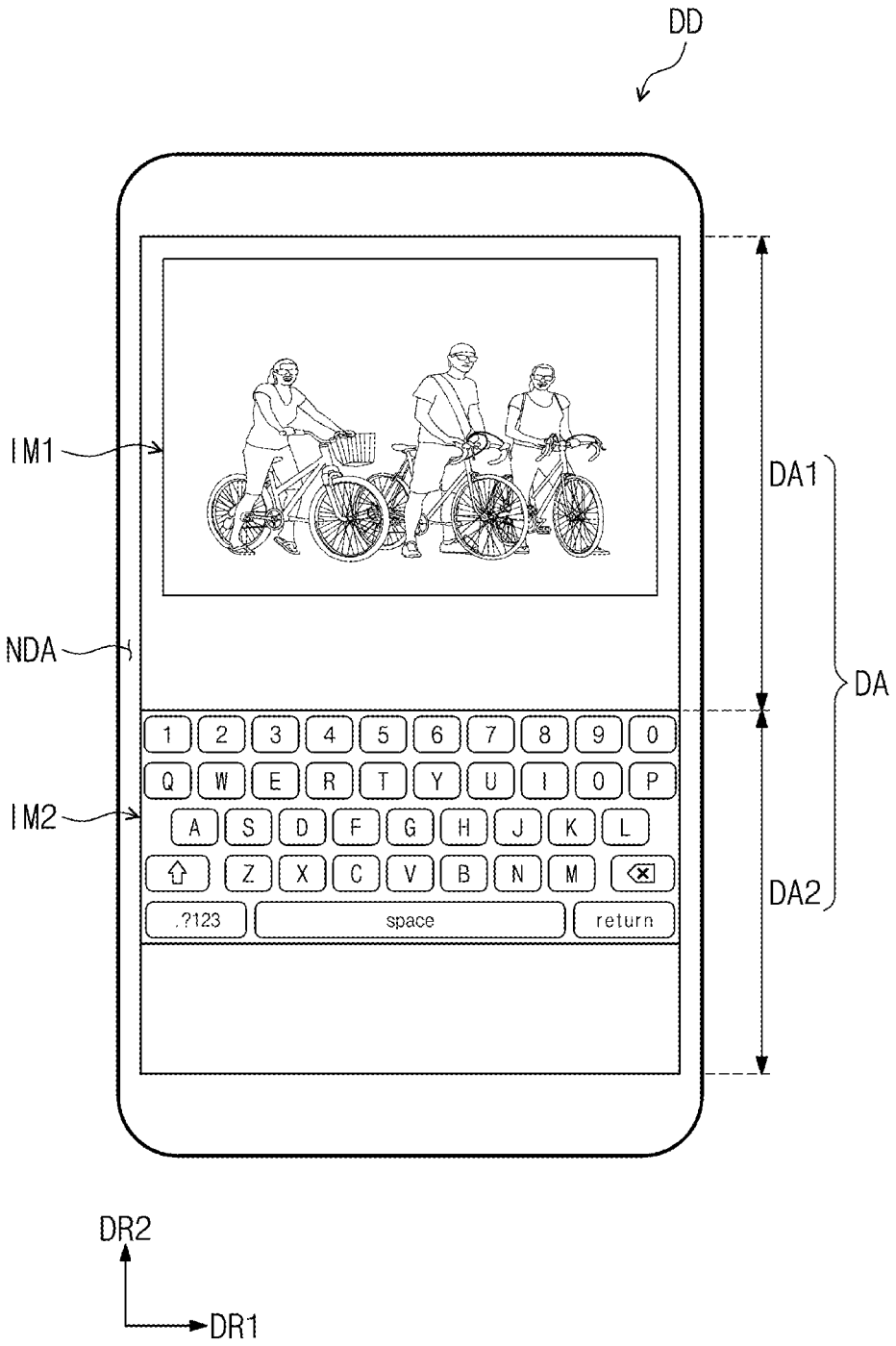
FIG. 1 is a perspective view of an embodiment of a display device according to the invention.

In the disclosure, when an element (or a region, a layer, a portion, etc.) is referred to as being "on," "connected to," or "coupled to" another element, it means that the element may be directly disposed on/connected to/coupled to the other element, or that a third element may be disposed therebetween.

Like reference numerals refer to like elements. Also, in the drawings, the thickness, the ratio, and the dimensions of elements are exaggerated for an effective description of technical contents. The term "and/or" includes all combinations of one or more of which associated configurations may define.

It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the inventive concept. The terms of a singular form may include plural forms unless the context clearly indicates otherwise.

In addition, terms such as "below," "lower," "above," "upper," and the like are used to describe the relationship of the configurations shown in the drawings. The terms are used as a relative concept and are described with reference to the direction indicated in the drawings.

It should be understood that the terms "comprise", or "have" are intended to specify the presence of stated features, integers, steps, operations, elements, components, or combinations thereof in the disclosure, but do not preclude the presence or addition of one or more other features, integers, steps, operations, elements, components, or combinations thereof.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which the inventive concept pertains. It is also to be understood that terms defined in commonly used dictionaries should be interpreted as having meanings consistent with the meanings in the context of the related art, and are not interpreted in an ideal or overly formal sense unless they are expressly so defined herein.

Hereinafter, embodiments of the invention will be described with reference to the accompanying drawings.

FIG. 1 is a perspective view of an embodiment of a display device according to the invention.

Referring to FIG. 1, as an embodiment of a display device DD according to the invention, a portable terminal is illustrated. The portable terminal may include a tablet personal computer ("PC"), a smart phone, a personal digital assistant ("PDA"), a portable multimedia player ("PMP"), a game console, a wristwatch-type electronic device, and the like. However, the invention is not limited thereto. Embodiments of the invention may be used for large electronic devices such as a television or an external advertisement board, and also for small and medium-sized electronic devices such as a personal computer, a laptop computer, a kiosk, a car navigation system unit, and a camera. It should be understood that these are merely embodiments and may be employed in other electronic devices without departing from the inventive concept.

As illustrated in FIG. 1, a display surface on which a first image IM1 and a second image IM2 are displayed is parallel to a plane defined by a first direction DR1 and a second direction DR2. The display device DD includes a plurality of regions separated on the display surface. The display surface includes a display region DA in which the first image IM1 and the second image IM2 are displayed and a non-display region NDA adjacent to the display region DA. The non-display region NDA may be also referred to as a bezel region. In an embodiment, the display region DA may have a quadrangular shape. The non-display region NDA surrounds the display region DA. In addition, although not shown, as one example, the display device DD may include a partially curved shape. As a result, one region of the display device DD may have a curved shape.

The display region DA of the display device DD includes a first display region DA1 and a second display region DA2. In a predetermined application program, the first image IM1 may be displayed in the first display region DA1, and the second image IM2 may be displayed in the second display region DA2. In an embodiment, the first image IM1 may be a moving image, and the second image IM2 may be a still image or text information having a long change period, for example.

The display device DD in an embodiment may drive the first display region DA1 in which a moving image is displayed at a normal frequency, and may drive the second display region DA2 in which a still image is displayed at a frequency lower than the normal frequency. The display device DD may reduce power consumption by lowering the driving frequency of the second display region DA2.

The size of each of the first display region DA1 and the second display region DA2 may be a predetermined size, and may be changed by an application program. In an embodiment, when the first display region DA1 displays a still image and the second display region DA2 displays a moving image, the first display region DA1 may be driven at a lower frequency and the second display region DA2 may be driven at a normal frequency. In addition, the display region DA may be divided into three or more display regions, and according to the type of an image (still image or moving image) displayed in each of the display regions, a driving frequency of each of the display regions may be determined.

Figure 2A:
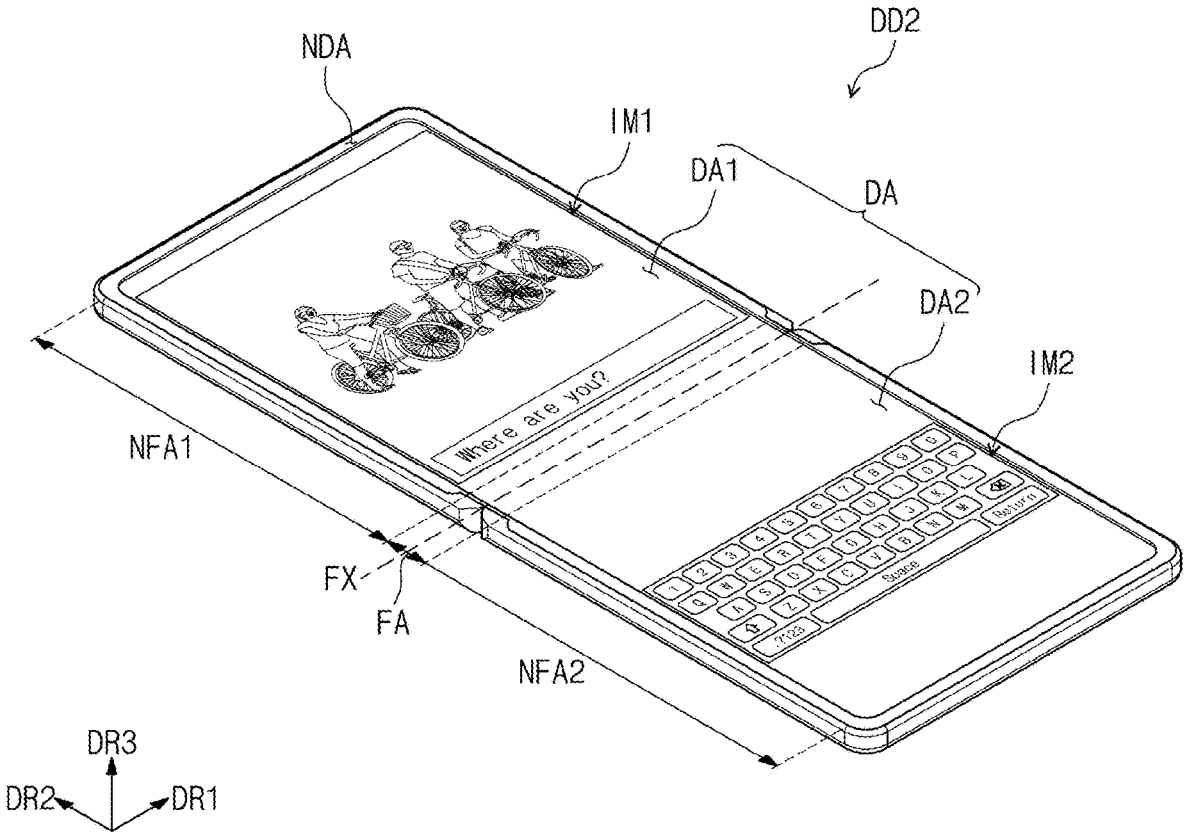
FIG. 2A and FIG. 2B are perspective views of an embodiment of a display device according to the invention.
Figure 2B:
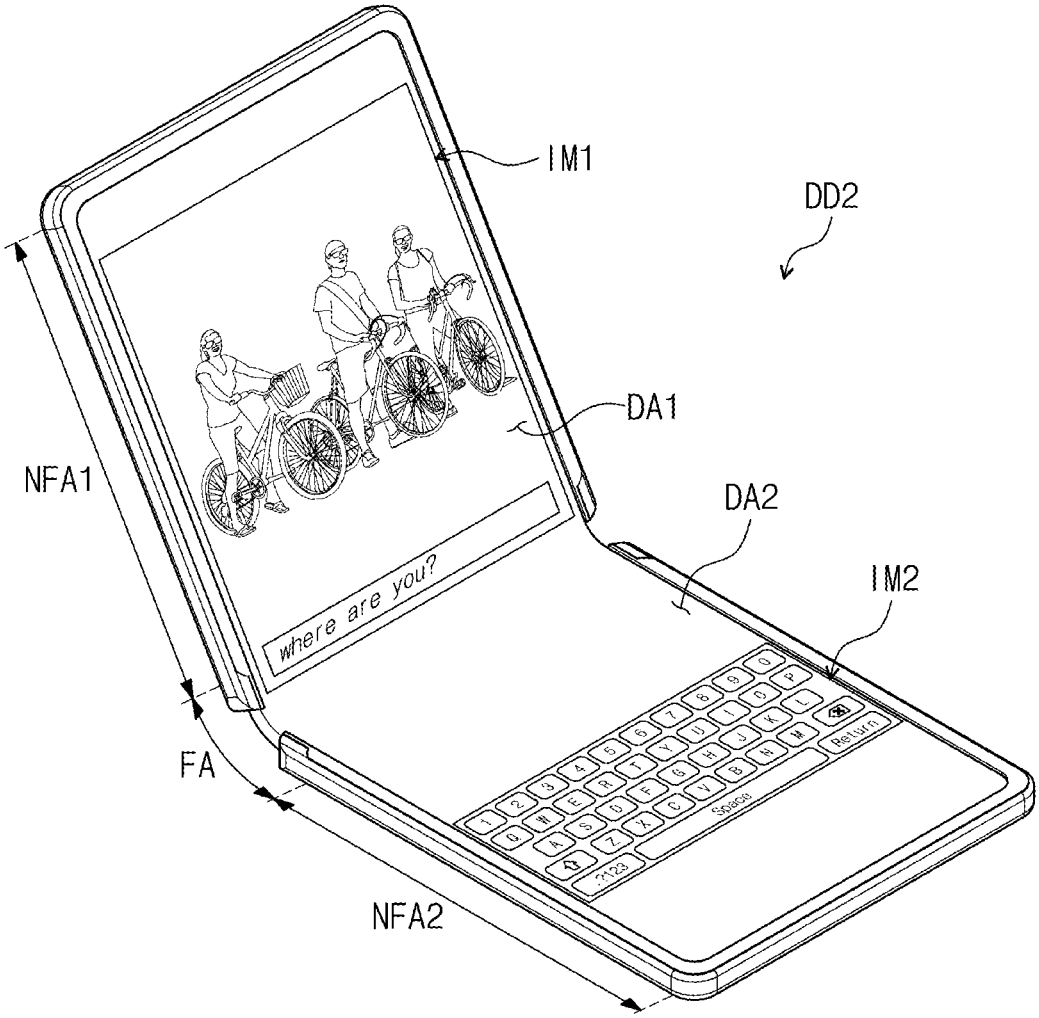

FIG. 2A and FIG. 2B are perspective views of an embodiment of a display device DD2 according to the invention. FIG. 2A illustrates the display device DD2 in an unfolded state, and FIG. 2B illustrates the display device DD2 in a folded state.

As illustrated in FIG. 2A and FIG. 2B, the display device DD2 includes a display region DA and a non-display region NDA. The display device DD2 may display an image through the display region DA. When the display device DD2 is an unfolded state, the display region DA may include a plane defined by a first direction DR1 and a second direction DR2. The thickness direction of the display device DD2 may be parallel to a third direction DR3 intersecting the first direction DR1 and the second direction DR2. Therefore, a front surface (or an upper surface) and a rear surface (or a lower surface) of members constituting the display device DD2 may be defined based on the third direction DR3. The non-display region NDA may be also referred to as a bezel region. In an embodiment, the display region DA may have a quadrangular shape. The non-display region NDA surrounds the display region DA.

The display region DA may include a first non-folding region NFA1, a folding region FA, and a second non-folding region NFA2. The folding region FA may be bent with reference to a folding axis FX extending along the first direction DR1.

When the display device DD2 is folded, the first non-folding region NFA1 and the second non-folding region NFA2 may face each other. Therefore, in a completely folded state, the display region DA may not be exposed to the outside, which may be also referred to as in-folding. However, this is only exemplary. The operation of the display device DD2 is not limited thereto.

In an embodiment of the invention, when the display device DD2 is folded, the first non-folding region NFA1 and the second non-folding region NFA2 may oppose each other, for example. Therefore, in a folded state, the first non-folding region NFA1 may be exposed to the outside, which may be also referred to as out-folding.

The display device DD2 may perform either an in-folding operation or an out-folding operation. In an alternative embodiment, the display device DD2 may perform both an in-folding operation and an out-folding operation. In this case, the same region of the display device DD2, for example, the folding region FA may be in-folded and out-folded. In an alternative embodiment, some regions of the display device DD2 may be in-folded, and the other regions thereof may be out-folded.

In FIG. 2A and FIG. 2B, one folding region and two non-folding regions are illustrated. However, the number of folding regions and non-folding regions is not limited thereto. In an embodiment, the display device DD2 may include a plurality of non-folding regions, which is more than two, and a plurality of folding regions disposed between non-folding regions adjacent to each other, for example.

In FIG. 2A and FIG. 2B, the folding axis FX is illustrated as being parallel to a short axis of the display device DD2, but the invention is not limited thereto. In an embodiment, the folding axis FX may extend along a long axis of the display device DD2, for example, a direction parallel to the second direction DR2. In this case, the first non-folding region NFA1, the folding region FA, and the second non-folding region NFA2 may be sequentially arranged along the first direction DR1, for example.

In the display region DA of the display device DD2, a plurality of display regions DA1 and DA2 may be defined. In FIG. 2A, two display regions DA1 and DA2 are illustrated. However, the number of the plurality of display regions DA1 and DA2 is not limited thereto.

The plurality of display regions DA1 and DA2 may include a first display region DA1 and a second display region DA2. In an embodiment, the first display region DA1 may be a region in which a first image IM1 is displayed, and the second display region DA2 may be a region in which a second image IM2 is displayed, for example. However, the invention is not limited thereto. In an embodiment, the first image IM1 may be a moving image, and the second image IM2 may be a still image or an image (text information, etc.) having a long change period, for example.

The display device DD2 in an embodiment may operate differently according to an operation mode. The operation mode may include a normal mode and a multi-frequency mode. In the normal mode, the display device DD2 may drive both the first display region DA1 and the second display region DA2 at a normal frequency. In the multi-frequency mode, the display device DD2 in an embodiment may drive the first display region DA1 in which the first image IM1 is displayed at a first driving frequency and may drive the second display region DA2 in which the second image IM2 is displayed at a second driving frequency which is lower than the normal frequency. In an embodiment, the first driving frequency may be the same as the normal frequency.

The size of each of the first display region DA1 and the second display region DA2 may be predetermined, and may be changed by an application program. In an embodiment, the first display region DA1 may correspond to the first non-folding region NFA1 and the second display region DA2 may correspond to the second non-folding region NFA2. In addition, a first portion of the folding region FA may correspond to the first display region DA1 and a second portion of the folding region FA may correspond to the second display region DA2.

In an embodiment, an entirety of the folding region FA may correspond to either the first display region DA1 or the second display region DA2.

In an embodiment, the first display region DA1 may correspond to a first portion of the first non-folding region NFA1 and the second display region DA2 may correspond to a second portion of the first non-folding region NFA1, the folding region FA, and the second non-folding region NFA2. That is, the area of the first display region DA1 may be smaller than the area of the second display region DA2.

In an embodiment, the first display region DA1 may correspond to the first non-folding region NFA1, the folding region FA, and a first portion of the second non-folding region NFA2, and the second display region DA2 may correspond to a second portion of the second non-folding region NFA2. That is, the area of the second display region DA2 may be smaller than the area of the first display region DA1.

As illustrated in FIG. 2B, when the folding region FA is in a folded state, the first display region DA1 may correspond to the first non-folding region NFA1 and the second display region DA2 may correspond to the second non-folding region NFA2.

In FIG. 2A and FIG. 2B, the display device DD2 having one folding region is illustrated as an embodiment of a display device. However, the invention is not limited thereto. In an embodiment, the invention may be applied to a display device including two or more folding regions, a rollable display device, a slidable display device, or the like, for example.

In the following description, the display device DD illustrated in FIG. 1 will be described as an example. However, the same may be applied to the display device DD2 illustrated in FIG. 2A and FIG. 2B.

Figure 3A:
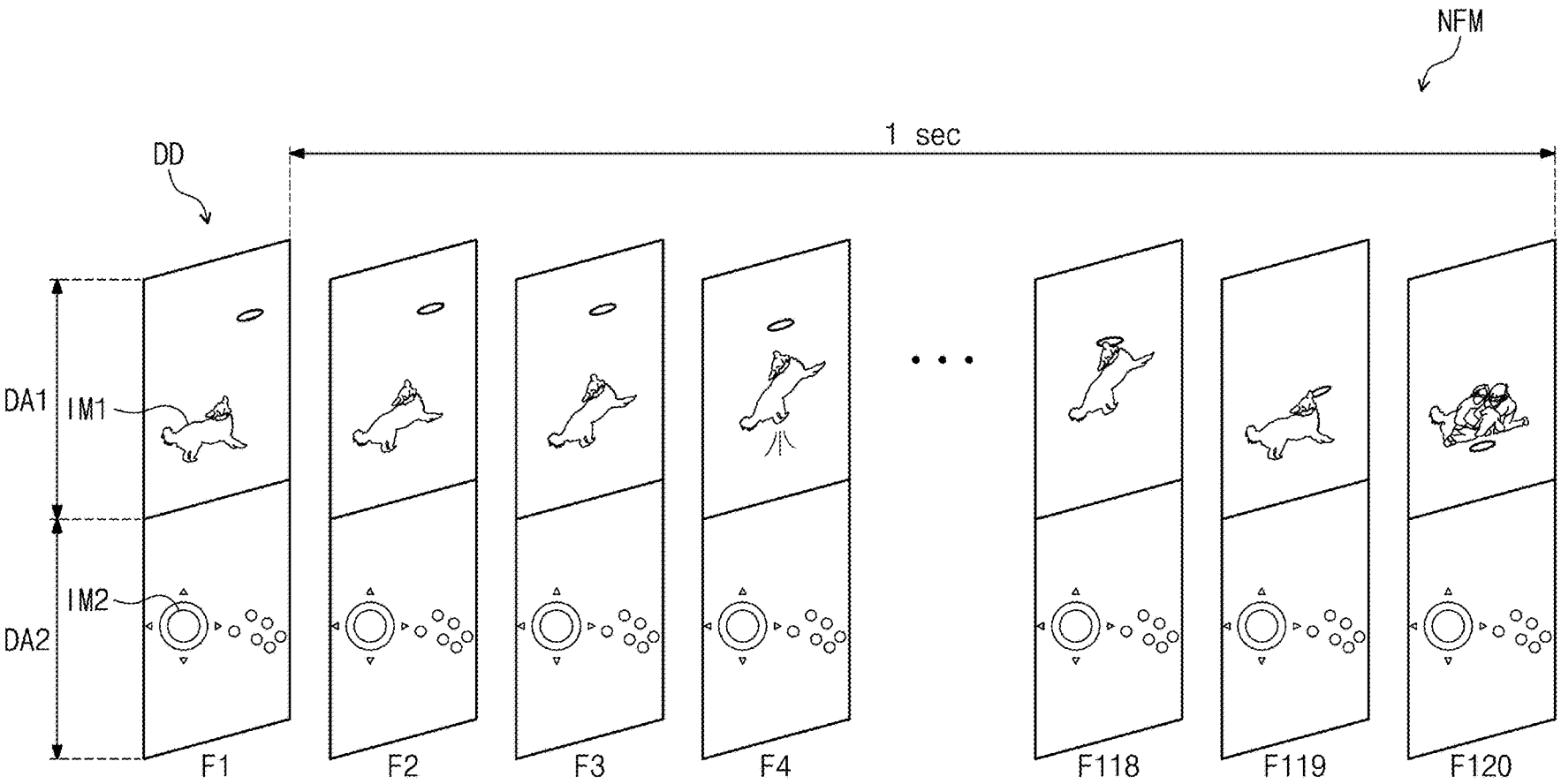
FIG. 3A is a view for describing the operation of a display device in a normal mode.
Figure 3B:
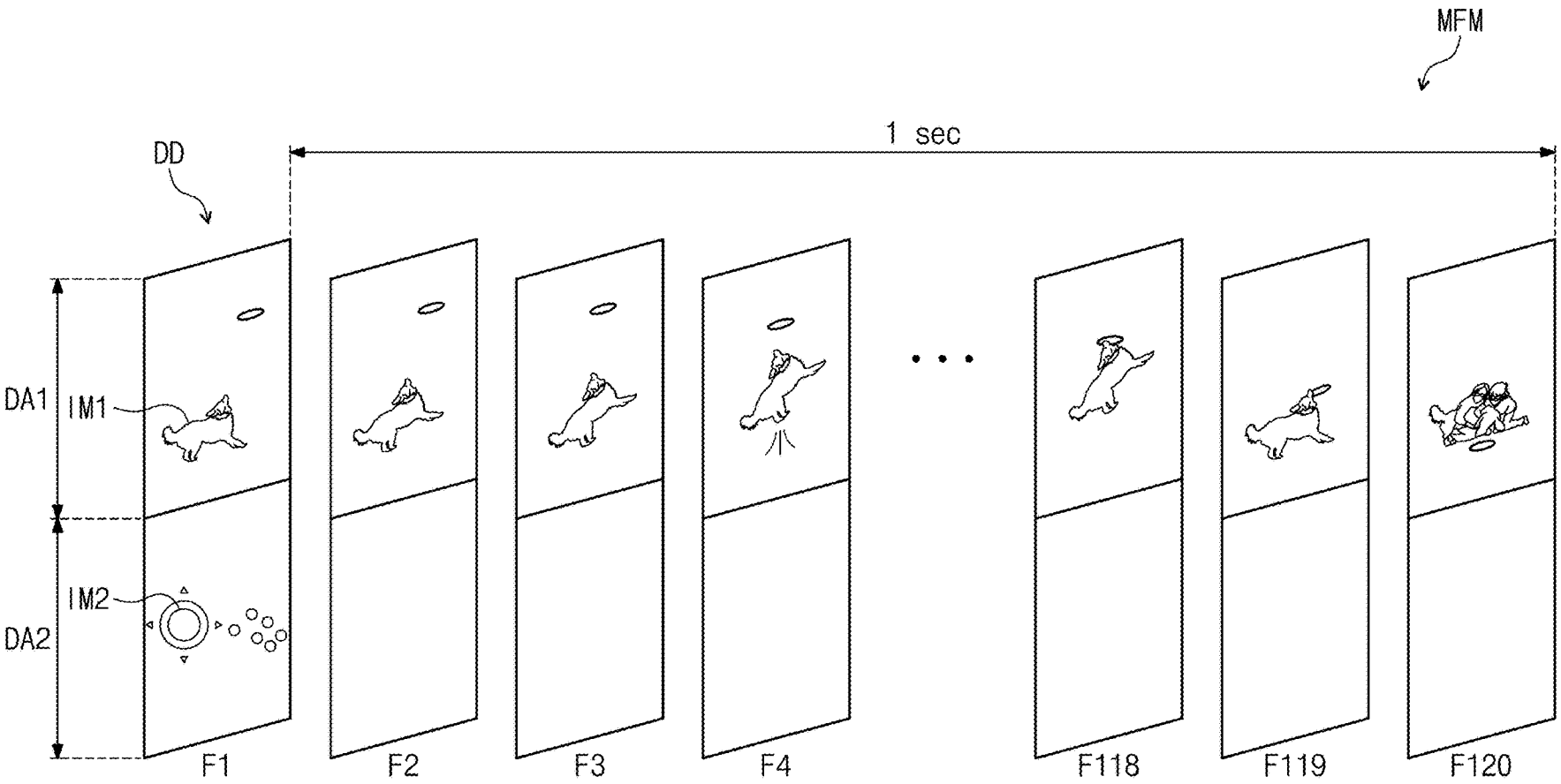
FIG. 3B is a view for describing the operation of a display device in a multi-frequency mode.

FIG. 3A is a view for describing the operation of a display device in a normal mode. FIG. 3B is a view for describing the operation of a display device in a multi-frequency mode.

Referring to FIG. 3A, the first image IM1 to be displayed in the first display region DA1 may be a moving image, and the second image IM2 to be displayed in the second display region DA2 may be a still image or an image (for example, a keypad for game operation) having a long change period. The first image IM1 to be displayed in the first display region DA1 and the second image IM2 to be displayed in the second display region DA2 illustrated in FIG. 1 are only exemplary. Various images may be displayed in the display device DD.

In a normal mode NFM, the driving frequency of the first display region DA1 and the second display region DA2 of the display device DD is a normal frequency. In an embodiment, the normal frequency may be about 120 hertz (Hz). In the normal mode NFM, in the first display region DA1 and the second display region DA2 of the display device DD, images of a first frame F1 to a 120-th frame F120 may be displayed for one second, for example.

Referring to FIG. 3B, in a multi-frequency mode MFM, the display device DD may set the driving frequency of the first display region DA1 in which the first image IM1, that is a moving image, is displayed to a first driving frequency, and may set the driving frequency of the second display region DA2 in which the second image IM2, that is a still image, is displayed to a second driving frequency which is lower than the first driving frequency. When the normal frequency is about 120 Hz, the first driving frequency may be about 120 Hz, and the second driving frequency may be about 1 Hz. The first driving frequency and the second driving frequency may vary. In an embodiment, the first driving frequency may be about 144 Hz, which is higher than the normal frequency, and the second driving frequency may be any one of about 30 Hz, and about 10 Hz, which are lower than the normal frequency, for example.

When the first driving frequency is 120 Hz and the second driving frequency is 1 Hz in the multi-frequency mode MFM, in the first display region DA1 of the display device DD, the first image IM1 is displayed for one second in each of the first frame F1 to a 120-th frame F120. The second image IM2 may be displayed only in the first frame F1 in the second display region DA2, and an image may not be displayed in the rest of frames F2 to F120. The operation of the display device DD in the multi-frequency mode MFM will be described in detail later.

Figure 4:
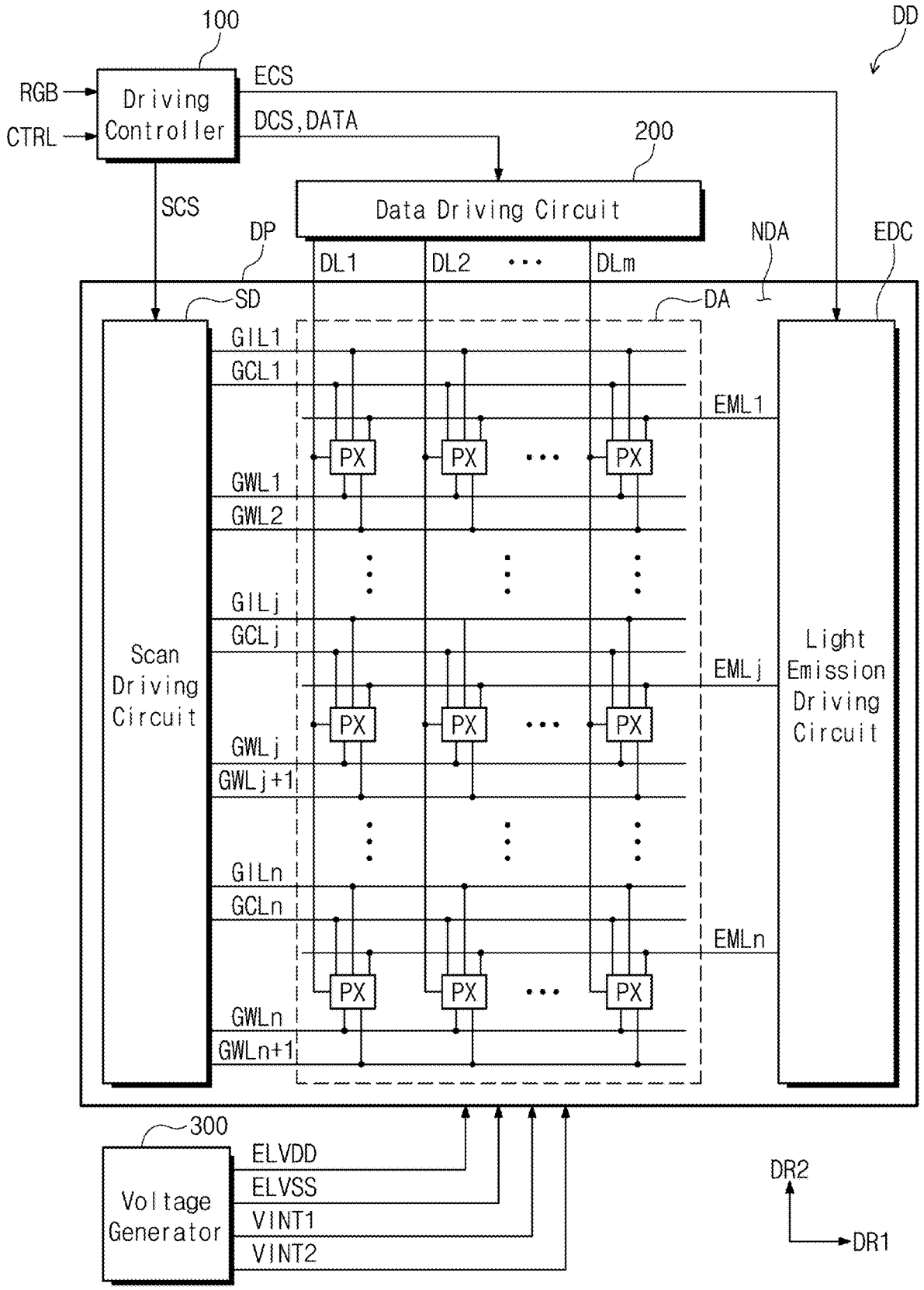
FIG. 4 is a block diagram of an embodiment of a display device according to the invention.

FIG. 4 is a block diagram of an embodiment of a display device according to the invention.

Referring to FIG. 4, the display device DD includes a display panel DP, a driving controller 100, a data driving circuit 200, and a voltage generator 300.

The driving controller 100 receives an image signal RGB and a control signal CTRL. The driving controller 100 generates an image data signal DATA obtained by converting the data format of the image signal RGB to meet the interface specifications of the data driving circuit 200. The driving controller 100 outputs a scan control signal SCS, a data control signal DCS, and a light emission control signal ECS.

The data driving circuit 200 receives the data control signal DCS and the image data signal DATA from the driving controller 100. The data driving circuit 200 converts the image data signal DATA into data signals and outputs the data signals to a plurality of data lines DL1 to DLm, where m is a natural number, to be described later. The data signals are analog voltages corresponding to gray scale values of the image data signal DATA.

The voltage generator 300 generates voltages desired for the operation of the display panel DP. In this embodiment, the voltage generator 300 generates a first driving voltage ELVDD, a second driving voltage ELVSS, a first initialization voltage VINT1, and a second initialization voltage VINT2.

The display panel DP includes scan lines GIL1 to GILn, GCL1 to GCLn, and GWL1 to GWLn+1, light emission control lines EML1 to EMLn, data lines DL1 to DLm, where n is a natural number, and pixels PX. The display panel DP may further include a scan driving circuit SD and a light emission driving circuit EDC. In an embodiment, the scan driving circuit SD is arranged on a first side (e.g., left side in FIG. 4) of the display panel DP. The scan lines GIL1 to GILn, GCL1 to GCLn, and GWL1 to GWLn+1 are extended in the first direction DR1 from the scan driving circuit SD.

The light emission driving circuit EDC is arranged on a second side (e.g., right side in FIG. 4) of the display panel DP. The light emission control lines EML1 to EMLn are extended from the light emission driving circuit EDC in a direction opposite to the first direction DR1.

The scan lines GIL1 to GILn, GCL1 to GCLn, and GWL1 to GWLn+1 and the light emission control lines EML1 to EMLn are arranged spaced apart from each other in the second direction DR2. The data lines DL1 to DLm are extended from the data driving circuit 200 in a direction opposite to the second direction DR2, and arranged spaced apart from each other in the first direction DR1.

In an example illustrated in FIG. 4, the scan driving circuit SD and the light emission driving circuit EDC are arranged facing each other with the pixels PX interposed therebetween, but the invention is not limited thereto. In an embodiment, the scan driving circuit SD and the light emission driving circuit EDC may be disposed adjacent to either the first side or the second side of the display panel DP, for example. In an embodiment, the scan driving circuit SD and the light emission driving circuit EDC may be formed as one circuit.

The plurality of pixels PX is electrically connected to the scan lines GIL1 to GILn, GCL1 to GCLn, and GWL1 to GWLn+1, the light emission control lines EML1 to EMLn, and data lines DL1 to DLm, respectively. Each of the plurality of pixels PX may be electrically connected to four scan lines and one light emission control line. In an embodiment, as illustrated in FIG. 4, pixels PX in a first row may be connected to scan lines GILL GCL1, GWL1, and GWL2, and a light emission control line EML1. In addition, pixels PX in a second row may be connected to scan lines GIL2, GCL2, GWL2 and GWL3, and a light emission control line EML2, for example.

Each of the plurality of pixels PX includes a light emitting diode ED (refer to FIG. 5) and a pixel circuit PXC (refer to FIG. 5) which controls the light emission of the light emitting diode ED. The pixel circuit PXC may include one or more transistors and one or more capacitors. The scan driving circuit SD and the light emission driving circuit EDC may include transistors formed in the same process as the pixel circuit PXC.

Each of the plurality of pixels PX receives the first driving voltage ELVDD, the second driving voltage ELVSS, the first initialization voltage VINT1, and the second initialization voltage VINT2.

The scan driving circuit SD receives the scan control signal SCS from the driving controller 100. The scan driving circuit SD may output scan signals to the scan lines GIL1 to GILn, GCL1 to GCLn, and GWL1 to GWLn+1 in response to the scan control signal SCS. The circuit configuration and operation of the scan driving circuit SD will be described in detail later.

The driving controller 100 in an embodiment may divide the display panel DP into the first display region DA1 (refer to FIG. 1) and the second display regions DA2 (refer to FIG. 1) based on the image signal RGB, and may set the driving frequency of the first display region DA1 and of the second display region DA2. In an embodiment, the driving controller 100 drives each of the first display region DA1 and the second display region DA2 at a normal frequency (e.g., about 120 Hz) in a normal mode, for example. The driving controller 100 may drive the first display region DA1 at a first driving frequency (e.g., about 120 Hz), and may drive the second display region DA2 at a low frequency (e.g., about 1 Hz) in a multi-frequency mode.

Figure 5:
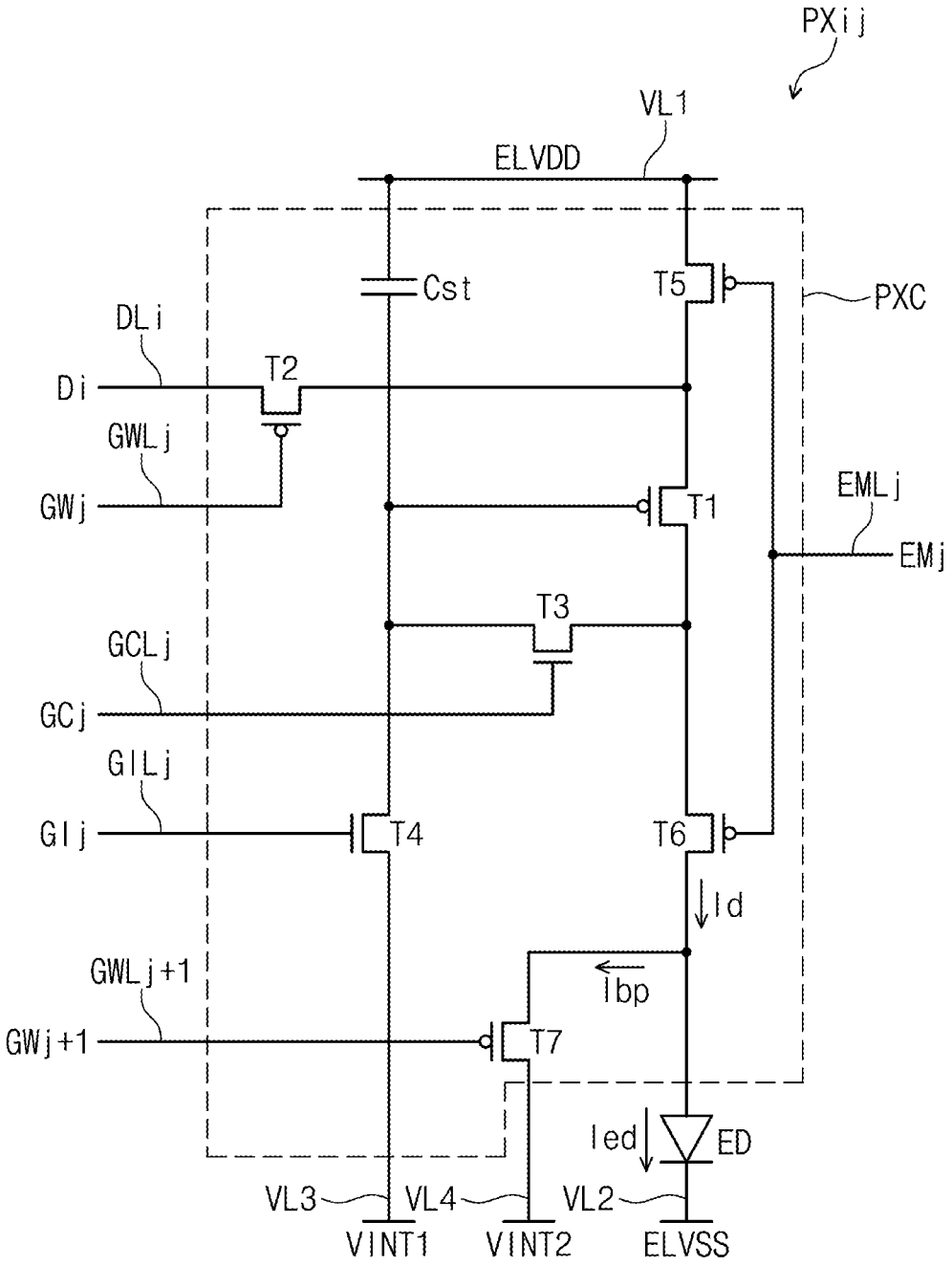
FIG. 5 is an equivalent circuit diagram of an embodiment of a pixel according to the invention.

FIG. 5 is an equivalent circuit diagram of an embodiment of a pixel according to the invention.

FIG. 5 illustrates an equivalent circuit diagram of a pixel PXij connected to an i-th data line DLi among the data lines DL1 to DLm, j-th scan lines GILj, GCLj, and GWLj and a j+1-th scan line GWLj+1 among scan lines GIL1 to GILn, GCL1 to GCLn and GWL1 to GWLn+1, and a j-th light emission control line EMLj among the light emission control lines EML1 to EMLn illustrated in FIG. 4. Here, i and j may be a natural number.

Each of the plurality of pixels PX illustrated in FIG. 4 may have the same circuit configuration as that shown in the equivalent circuit diagram of the pixel PXij illustrated in FIG. 5. In this embodiment, in the pixel circuit PXC of the pixel PXij, third and fourth transistors T3 and T4 among first to seventh transistors T1 to T7 are each an n-type transistor having an oxide semiconductor as a semiconductor layer, and each of first, second, fifth, sixth, and seventh transistors T1, T2, T5, T6, and T7 is a P-type transistor having a low-temperature polycrystalline silicon ("LTPS") semiconductor layer. However the invention is not limited thereto. All of the first to seventh transistors T1 to T7 may be p-type transistors or n-type transistors. In another embodiment, at least one of the first to seventh transistors T1 to T7 may be an n-type transistor and the rest thereof may be a p-type transistor. Also, the circuit configuration of a pixel according to the invention is not limited to what is shown in FIG. 5. The pixel circuit PXC illustrated in FIG. 5 is only exemplary, and the configuration of the pixel circuit PXC may be modified and implemented.

Referring to FIG. 5, the pixel PXij of the display device in an embodiment includes the first to seventh transistors T1, T2, T3, T4, T5, T6, and T7, the capacitor Cst, and at least one light emitting diode ED. In this embodiment, one pixel PXij including one light emitting diode ED will be described as an example.

Hereinafter, for convenience of the description, the i-th data line DLi may be referred to as a data line DLi, the j-th scan lines GILj, GCLj, and GWLj may be referred to as scan lines GILj, GCLj, and GWLj, the j+l-th scan line GWLj+1 may be referred to as a scan line GWLj+1, and the j-th light emission control line EMLj may be referred to as a light emission control line EMLj. The scan lines GILj, GCLj, GWLj, and GWLj+1 may respectively transmit scan signals GIj, GCj, GWj, and GWj+1, and the light emission control line EMLj may transmit a light emission signal EMj. The data line DLi transmits a data signal Di. The data signal Di may have a voltage level corresponding to the image signal RGB input to the display device DD (refer to FIG. 4). First to fourth driving voltage lines VL1, VL2, VL3, and VL4 may respectively transmit the first driving voltage ELVDD, the second driving voltage ELVSS, the first initialization voltage VINT1, and the second initialization voltage VINT2.

A first transistor T1 includes a first electrode connected to a first driving voltage line VL1 via a fifth transistor T5, a second electrode electrically connected to an anode of the light emitting diode ED via a sixth transistor T6, and a gate electrode connected to one end of the capacitor Cst. The first transistor T1 may receive the data signal Di transmitted by the data Line DLi in accordance with the switching operation of a second transistor T2 and supply a driving current Id to the light emitting diode ED.

The second transistor T2 includes a first electrode connected to the data line DLi, a second electrode connected to the first electrode of the first transistor T1, and a gate electrode connected to a scan line GWLj. The second transistor T2 may be turned on according to a scan signal GWj received through the scan line GWLj to transmit the data signal Di transmitted from the data line DLi to the first electrode of the first transistor T1.

A third transistor T3 includes a first electrode connected to the gate electrode of the first transistor T1, a second electrode connected to the second electrode of the first transistor T1, and a gate electrode connected to a scan line GCLj. The third transistor T3 may be turned on according to a scan signal GCj received through the scan line GCLj to connect the gate electrode of the first transistor T1 and the second electrode so as to diode connect the first transistor T1.

A fourth transistor T4 includes a first electrode connected to the gate electrode of the first transistor T1, a second electrode connected to a third driving voltage line VL3 through which the first initialization voltage VINT1 is transmitted, and a gate electrode connected to a scan line GILj. The fourth transistor T4 may be turned on according to a scan signal GIj received through the scan line GILj to transmit the first initialization voltage VINT1 to the gate electrode of the first transistor T1 so as to perform an initialization operation to initialize the voltage of the gate electrode of the first transistor T1.

A fifth transistor T5 includes a first electrode connected to the first driving voltage line VL1, a second electrode connected to the first electrode of the first transistor T1, and a gate electrode connected to the light emission control line EMLj.

A sixth transistor T6 includes a first electrode connected to the second electrode of the first transistor T1, a second electrode connected the anode of the light emitting diode ED, and a gate electrode connected to the light emission control line EMLj.

The fifth transistor T5 and the sixth transistor T6 are simultaneously turned on according to the light emission signal EMj received through the light emission control line EMLj, and as a result, the first driving voltage ELVDD may be compensated through the diode-connected first transistor T1 and transmitted to the light emitting diode ED.

A seventh transistor T7 includes a first electrode connected to the second electrode of the sixth transistor T6, a second electrode connected to a fourth voltage line VL4, and a gate electrode connected to the scan line GWLj+1. The seventh transistor T7 is turned on according to a scan signal GWj+1 received through the scan line GWLj+1 to bypass the current of the anode of the light emitting diode ED to the fourth voltage line VL4.

The one end of the capacitor Cst is connected to the gate electrode of the first transistor T1 as described above, and the other end thereof is connected to the first driving voltage line VL1. A cathode of the light emitting diode ED may be connected to a second driving voltage line VL2 which transmits the second driving voltage ELVSS. The structure of the pixel PXij in an embodiment is not limited to the structure illustrated in FIG. 5. The number of transistors and the number of capacitors included in one pixel PXij and the connection relationship thereof may be variously modified.

Figure 6:
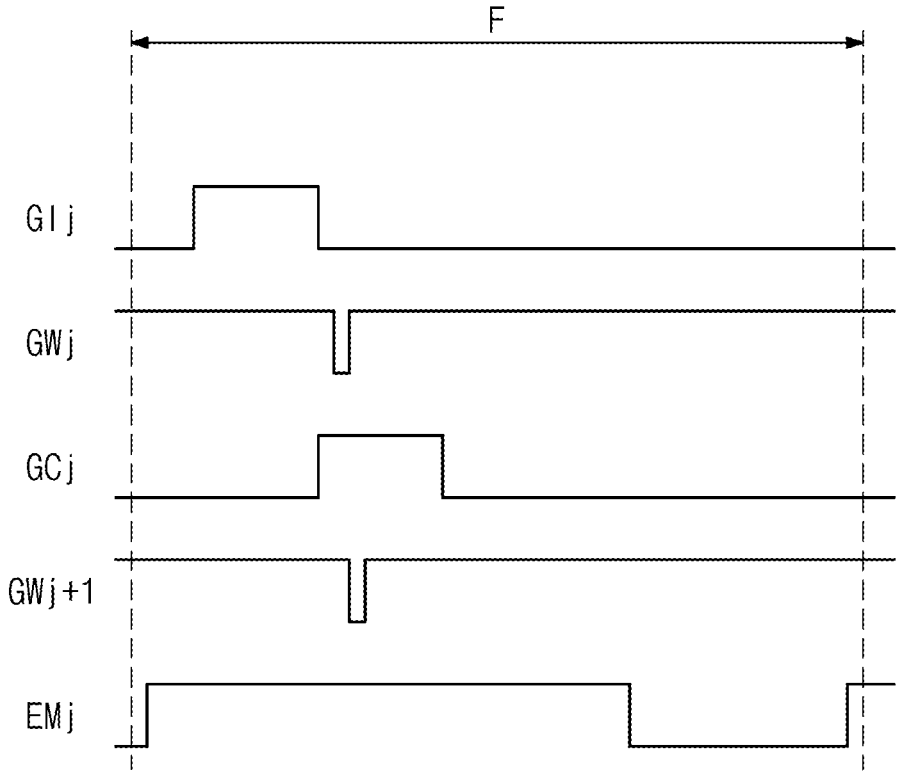
FIG. 6 is a timing diagram for explaining the operation of the pixel illustrated in FIG. 5.

FIG. 6 is a timing diagram for explaining the operation of the pixel illustrated in FIG. 5. Referring to FIG. 5 and FIG. 6, an embodiment of the operation of a display device will be described.

Referring FIG. 5 and FIG. 6, during an initialization period within one frame F, the scan signal GIj of a high level is supplied through the scan lines GILj. In response to the scan signal GIj of a high level, the fourth transistor T4 is turned on, and through the fourth transistor T4, the first initialization voltage VINT1 is transmitted to the gate electrode of the first transistor T1 to initialize the first transistor T1.

Next, when the scan signal GCj of a high level is supplied through a scan line GCLj during data programming and a compensation period, the third transistor T3 is turned on. The first transistor T1 is diode-connected by the turned-on third transistor T3, and is biased in a forward direction. In addition, the second transistor T2 is turned on by the scan signal GWj of a low level. Then, a compensation voltage Di-Vth reduced by a threshold voltage Vth of the first transistor T1 from the data signal Di supplied from the data line DLi is applied to the gate electrode of the first transistor T1. That is, a gate voltage applied to the gate electrode of the first transistor T1 may be the compensation voltage Di-Vth.

To both ends of the capacitor Cst, the first driving voltage ELVDD and the compensation voltage Di-Vth are respectively applied, and in the capacitor Cst, electric charges corresponding to the voltage difference between the both ends may be stored.

The seventh transistor T7 is turned on by being supplied with the scan signal GWj+1 of a low level through the scan line GWLj+1. A portion of the driving current Id may exit through the seventh transistor T7 as a bypass current Ibp by the seventh transistor T7.

When the light emitting diode ED emits light even while a minimum current of the first transistor T1 for displaying a black image flows as a driving current Id, the black image is not properly displayed. Accordingly, the seventh transistor T7 in the pixel PXij in an embodiment of the invention may direct a portion of the minimum current of the first transistor T1 as the bypass current Ibp to a current path other than a current path on the side of a light emitting diode ED. Here, the minimum current of the first transistor T1 refers to a current under a condition that the first transistor T1 is turned off since a gate-source voltage Vgs of the first transistor T1 is less than the threshold voltage Vth. As such, the minimum driving current under the condition that the first transistor T1 is turned off (for example, a current of about 10 picoampere (pA) or less) is transmitted to the light emitting diode ED and displayed as an image of black luminance. When the minimum driving current for displaying the black image flows, the effect of the bypass transmission of the bypass current Ibp is significant. However, when a large driving current for displaying an image, such as a normal image or a white image, flows, there is little effect of the bypass current Ibp. Accordingly, when a driving current Id for displaying a black image flows, a light emitting current Ted of the light emitting diode ED reduced by the bypass current Ibp exiting through the seventh transistor T7 from the driving current Id may have a minimum amount of current to a level so as to reliably display the black image. Accordingly, an image of correct black luminance may be implemented using the seventh transistor T7, so that the contrast ratio may be improved. In this embodiment, a bypass signal is the scan signal GWj+1 of a low level, but the embodiment of the invention is not necessarily limited thereto.

Next, the light emission signal EMj supplied from the light emission control line EMLj during a light emitting period is changed from a high level to a low level. During the light emitting period, the fifth transistor T5 and the sixth transistor T6 are turned on by the light emission signal EMj of a low level. Then, the driving current Id corresponding to the voltage difference between the gate voltage of the gate electrode of the first transistor T1 and the first driving voltage ELVDD is generated, and through the sixth transistor T6, the driving current Id is supplied to the light emitting diode ED such that the light emitting current led flows in the light emitting diode ED.

Figure 7:
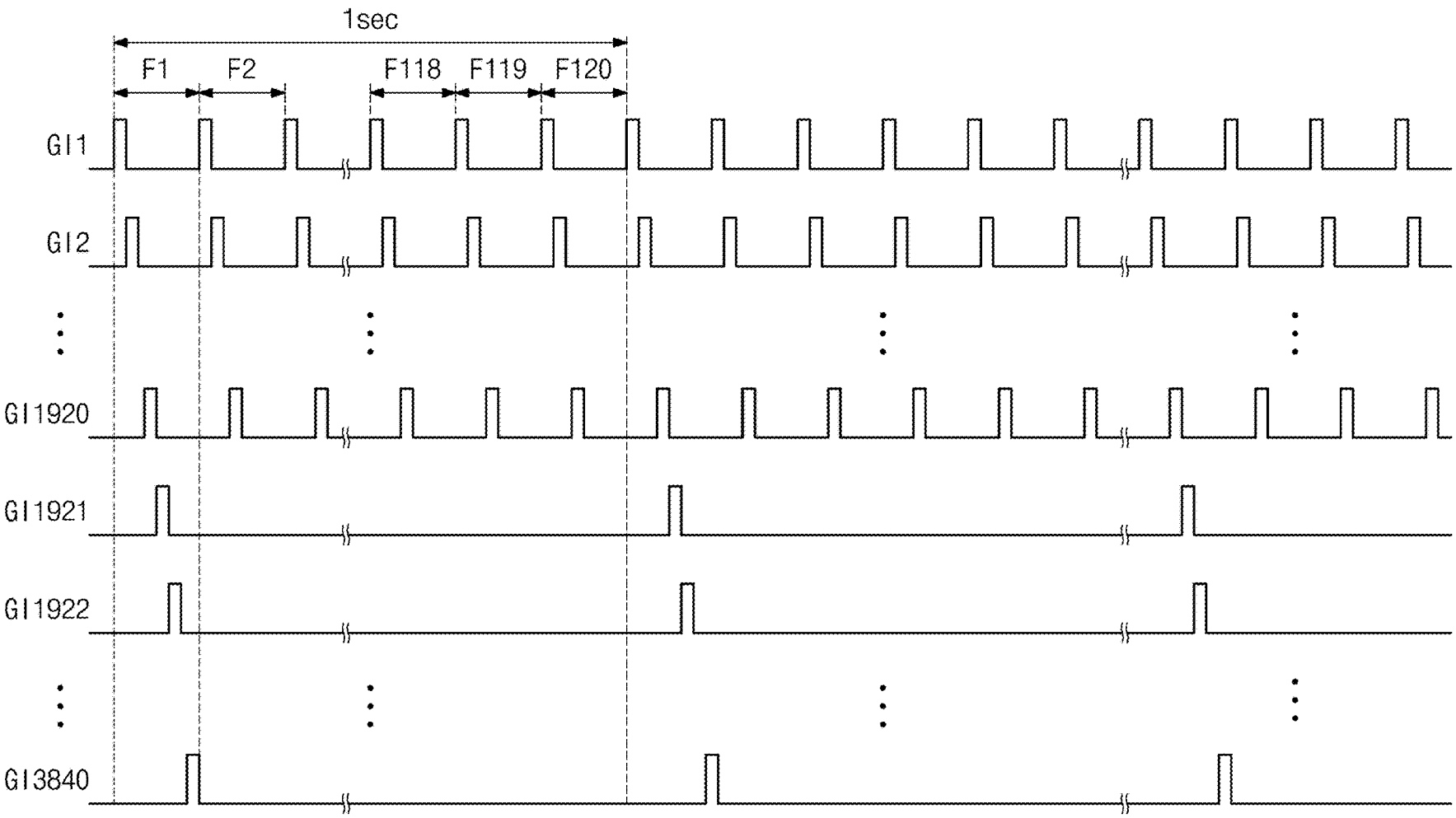
FIG. 7 shows scan signals in a multi-frequency mode.

FIG. 7 shows scan signals GI1 to GI3840 in a multi-frequency mode.

Referring to FIG. 7, in a multi-frequency mode, the frequency of scan signals GI1 to GI1920 is about 120 Hz, and the frequency of scan signals GI1921 to GI3840 is about 1 Hz.

In an embodiment, the scan signals GI1 to GI1920 correspond to the first display region DA1 of the display device DD illustrated in FIG. 1, and the scan signals GI1921 to GI3840 correspond to the second display region DA2 of the same, for example.

The scan signals GI1 to GI1920 may be activated to a high level in each of the first frame F1 to the 120-th frame F120, and the scan signals GI1921 to GI3840 may be activated to a high level only in the first frame F1.

Therefore, the first display region DA1 in which a moving image is displayed may be driven by the scan signals GI1 to GI1920 of a normal frequency (e.g., about 120 Hz), and the second display region DA2 in which a still image is displayed may be driven by the scan signals GI1921 to GI3840 of a low frequency (e.g., about 1 Hz). Since only the second display region DA2 in which a still image is displayed is driven at a low frequency, power consumption may be reduced without the deterioration in display quality of the display device DD (refer to FIG. 1).

FIG. 7 illustrates only the scan signals GI1 to GI3840. However, the scan driving circuit SD (refer to FIG. 4) and the light emission driving circuit EDC (refer to FIG. 4) may also generate scan signals GC1 to GC3840 and GW1 to GW3841 and light emission signals EM1 to EM3840 in a similar way of generating the scan signals GI1 to GI3840.

Figure 8:
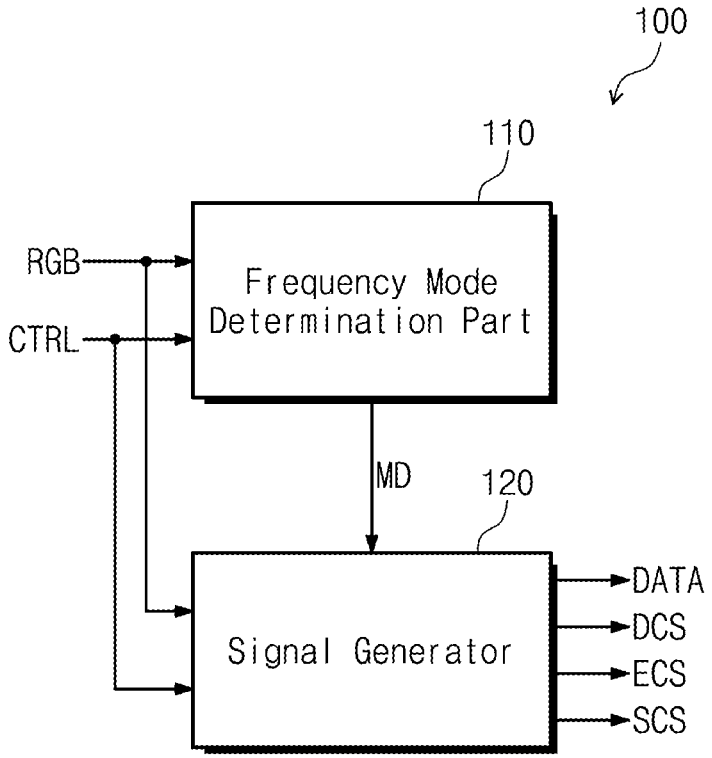
FIG. 8 is a block diagram showing an embodiment of the configuration of a driving controller according to the invention.

FIG. 8 is a block diagram showing an embodiment of the configuration of a driving controller according to the invention.

Referring to FIG. 4 and FIG. 8, a driving controller 100 includes a frequency mode determination part 110 and a signal generator 120. The frequency mode determination part 110 determines a frequency mode in response to the image signal RGB and the control signal CTRL, and outputs a mode signal MD corresponding to the determined frequency mode.

The signal generator 120 receives the image signal RGB, the control signal CTRL, and the mode signal MD from the frequency mode determination part 110. The signal generator 120 outputs the image data signal DATA, the data control signal DCS, the light emission control signal ECS, and the scan control signal SCS in response to the image signal RGB, the control signal CTRL, and the mode signal MD.

When the mode signal MD represents a normal mode, the signal generator 120 may output the image data signal DATA, the data control signal DCS, the light emission control signal ECS, and the scan control signal SCS to drive each of the first display region DA1 (refer to FIG. 1) and the second display region DA2 (refer to FIG. 1) at a normal frequency. The data driving circuit 200, the scan driving circuit SD, and the light emission driving circuit EDC illustrated in FIG. 4 operate in response to the image data signal DATA, the data control signal DCS, the light emission control signal ECS, and the scan control signal SCS such that an image is displayed on the display panel DP.

When the mode signal MD represents a multi-frequency mode, the signal generator 120 may output the image data signal DATA, the data control signal DCS, the light emission control signal ECS, and the scan control signal SCS to drive the first display region DA1 at a first driving frequency and to drive the second display region DA2 at a second driving frequency. In an embodiment, the first driving frequency may be the same frequency as the normal frequency. In an embodiment, the first driving frequency may be a frequency higher than the normal frequency.

The operation of the frequency mode determination part 110 will be described in detail later.

Figure 9:
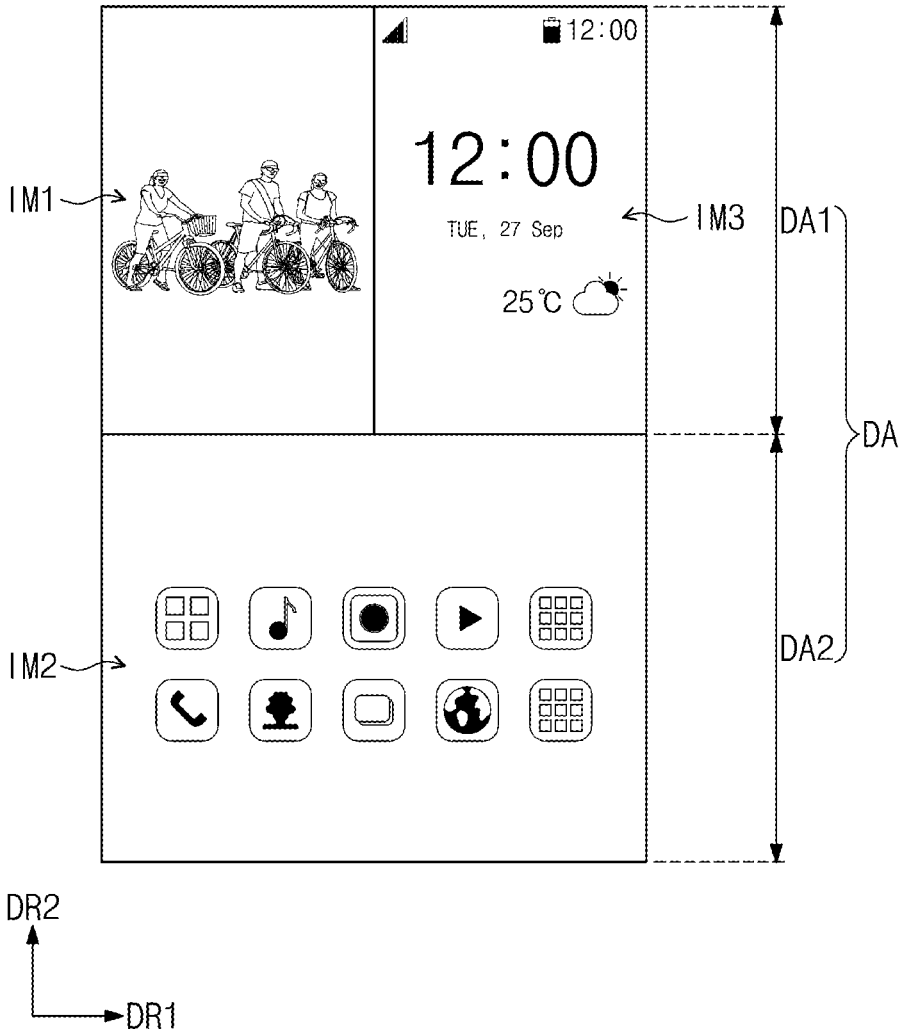
FIG. 9 is a view showing an image displayed on a display device.

FIG. 9 is a view showing an image displayed on a display device.

Referring to FIG. 9, the display region DA may include a first display region DA1 and a second display region DA2. The first image IM1 and a third image IM3 may be displayed in the first display region DA1, and the second image IM2 may be displayed in the second display region DA2. In an embodiment, the first image IM1 may be a moving image, and the second image IM2 and the third image IM3 may be still images. The second image IM2 and the third image IM3 may be images related to each other, or may be independent images. In an example illustrated in FIG. 9, the second image IM2 includes icons for executing application programs, and the third image IM3 includes information such as dates, time, and weather. However, the second image IM2 and the third image IM3 are not limited thereto.

Referring to FIG. 8 and FIG. 9, the frequency mode determination part 110 receives the image signal RGB and the control signal CTRL, determines an operation mode based on the image signal RGB and the control signal CTRL, and outputs a mode signal MD corresponding to the determined operation mode. In an embodiment, among image signals RGB, when an image signal RGB corresponding to the first display region DA1 includes a moving image and an image signal RGB corresponding to the second display region DA2 is a still image, the frequency mode determination part 110 changes the operation mode to a multi-frequency mode, and may output the mode signal MD, for example. Not only when the image signal RGB corresponding to the first display region DA1 includes a moving image, but also when the same includes both a moving image and a still image, the frequency mode determination part 110 may determine an operation mode as a multi-frequency mode when the image signal RGB corresponding to the second display region DA2 is a still image.

When the mode signal MD represents a multi-frequency mode, the signal generator 120 may output the image data signal DATA, the data control signal DCS, the light emission control signal ECS, and the scan control signal SCS to drive the first display region DA1 at a first driving frequency and to drive the second display region DA2 at a second driving frequency.

Therefore, the first image IM1, which is a moving image, and the third image IM3, which is a still image, may be displayed in the first display region DA1 at a first driving frequency, and the second image IM2 may be displayed in the second display region DA2 at a second driving frequency.

After a multi-frequency mode in which the first display region DA1 is driven at a first driving frequency and the second display region DA2 is driven at a second driving frequency has lasted for a predetermined period of time, a new image (e.g., an image with a high luminance) may be displayed in the first display region DA1 and the second display region DA2. At this time, depending on the duration of the multi-frequency mode, afterimages of the third image IM3 of the first display region DA1 and the second image IM2 of the second display region DA2 may affect the new image. Particularly, as the duration of a multi-frequency mode becomes longer and the luminance of a still image becomes higher, the afterimage phenomenon becomes worse.

Particularly, as in the example illustrated in FIG. 9, the afterimage phenomenon caused by the third image IM3 of the first display region DA1 driven at a first driving frequency may be worse than the afterimage phenomenon caused by the second image IM2 of the second display region DA2 driven at a second driving frequency. When the second image IM2 and the third image IM3 are images related to each other, the boundary between the first display region DA1 and the second display region DA2 may be visually recognized.

The frequency mode determination part 110 in an embodiment may terminate a multi-frequency mode and operate in a normal mode when a still image is displayed in the multi-frequency mode for a long period of time and/or the average luminance of the still image is higher than a reference luminance.

Figure 10:
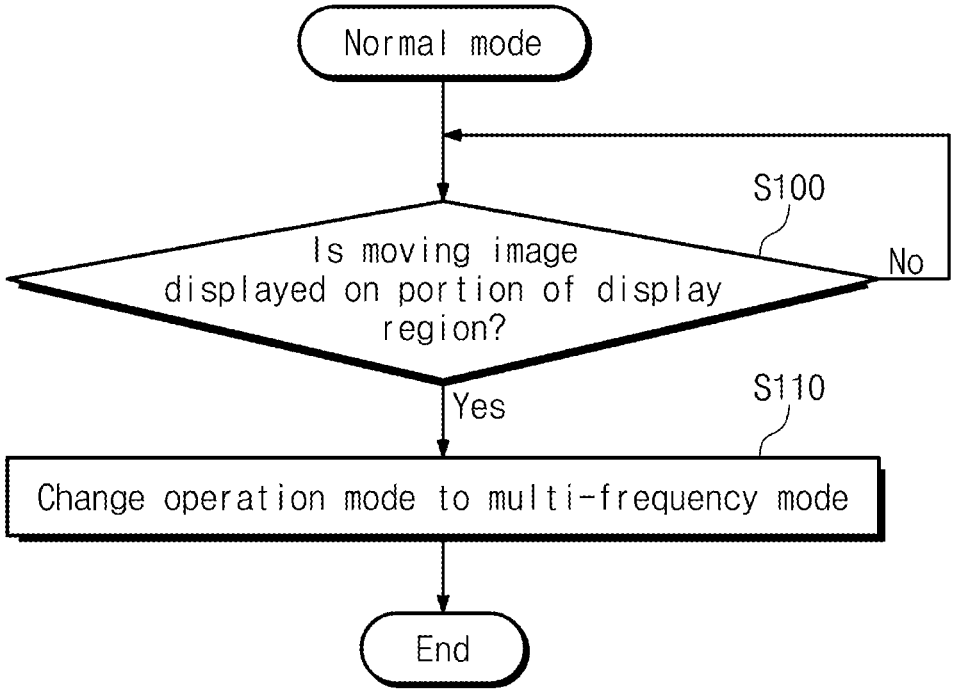
FIG. 10 is a flowchart showing an embodiment of the operation of a driving controller according to the invention.

FIG. 10 is a flowchart showing an embodiment of the operation of a driving controller according to the invention.

Referring to FIG. 8, FIG. 9, and FIG. 10, the frequency mode determination part 110 of the driving controller 100 may set an operation mode to a normal mode, initially (e.g., after a power-up).

The frequency mode determination part 110 determines a frequency mode in response to the image signal RGB and the control signal CTRL. In an embodiment, when a portion of the image signal RGB of one frame (e.g., an image signal corresponding to the first display region DA1) is a moving image, and another portion thereof (e.g., an image signal corresponding to the second display region DA2) is a still image (Operation S100), the frequency mode determination part 110 changes the operation mode to a multi-frequency mode and outputs a mode signal MD corresponding to the determined frequency mode (Operation S110), for example.

Figure 11:
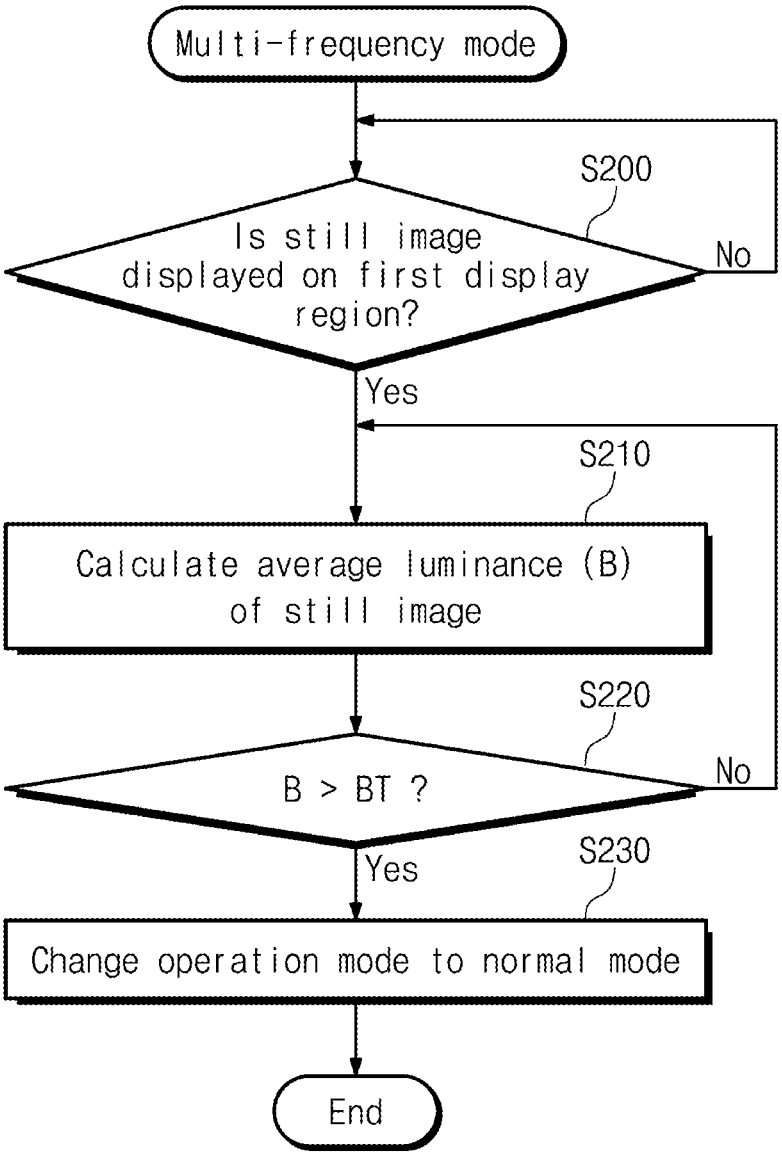
FIG. 11 is a flowchart showing an embodiment of the operation of a driving controller according to the invention in a multi-frequency mode.

FIG. 11 is a flowchart showing an embodiment of the operation of a driving controller according to the invention in a multi-frequency mode.

Referring to FIG. 8, FIG. 9, and FIG. 11, during a multi-frequency mode, the first display region DA1 may be driven at a first driving frequency, and the second display region DA2 may be driven at a second driving frequency lower than the first driving frequency.

The signal generator 120 may simultaneously display a moving image and a still image in the first display region DA1 in response to the image signal RGB and the control signal CTRL during a multi-frequency mode.

The frequency mode determination part 110 of the driving controller 100 determines whether a still image is displayed in the first display region DA1 in a multi-frequency mode (Operation S200). That is, the frequency mode determination part 110 determines whether the image signal RGB corresponding to the first display region DA1 includes both a moving image and a still image.

If, as illustrated in FIG. 9, the image signal RGB corresponding to the first display region DA1 includes both the first image IM1, which is a moving image, and the third image IM3, which is a still image, the frequency mode determination part 110 calculates an average luminance B of the still image (Operation S210).

The frequency mode determination part 110 determines whether the average luminance B of a still image is higher than a reference luminance BT (or a threshold luminance) (Operation S220). In an embodiment, the average luminance B of the still image may be an average luminance of the third image IM3 displayed in the first display region DA1. In an embodiment, the average luminance B of the still image may be the average luminance of the third image IM3 displayed in the first display region DA1 and the second image IM2 displayed in the second display region DA2.

When the average luminance B of the still image is lower than the reference luminance BT, the frequency mode determination part 110 maintains the operation mode as the multi-frequency mode. When the average luminance B of the still image is lower than the reference luminance BT, even when the still image is displayed for a long period of time and then switched to a new image, the influence caused by an afterimage may not be significant. Therefore, when the average luminance B of the still image is lower than the reference luminance BT, the frequency mode determination part 110 maintains the multi-frequency mode. As a result, the second display region DA2 is driven at the second driving frequency, so that power consumption may be reduced.

When the average luminance B of the still image is higher than the reference luminance BT, the frequency mode determination part 110 changes the operation mode to a normal mode (Operation S230). When the average luminance B of the still image is higher than the reference luminance BT, when the still image is displayed for a long period of time and then switched to a new image, there may be a difference in the degree of afterimage between the first display region DA1 and the second display region DA2. When afterimages are shown differently in the first and second display regions DA1 and DA2, the afterimages may be visually recognized by a user more easily, and the boundary between the first and second display regions DA1 and DA2 may be visually recognized by the user. Therefore, when the average luminance B of the still image is higher than the reference luminance BT, the frequency mode determination part 110 changes the operation mode to a normal mode to drive the first and second display regions DA1 and DA2 at a normal frequency. As a result, the afterimage deviation between the first and second display regions DA1 and DA2 may be minimized, and the boundary between the first and second display regions DA1 and DA2 may be prevented from being visually recognized by the user.

Figure 12:
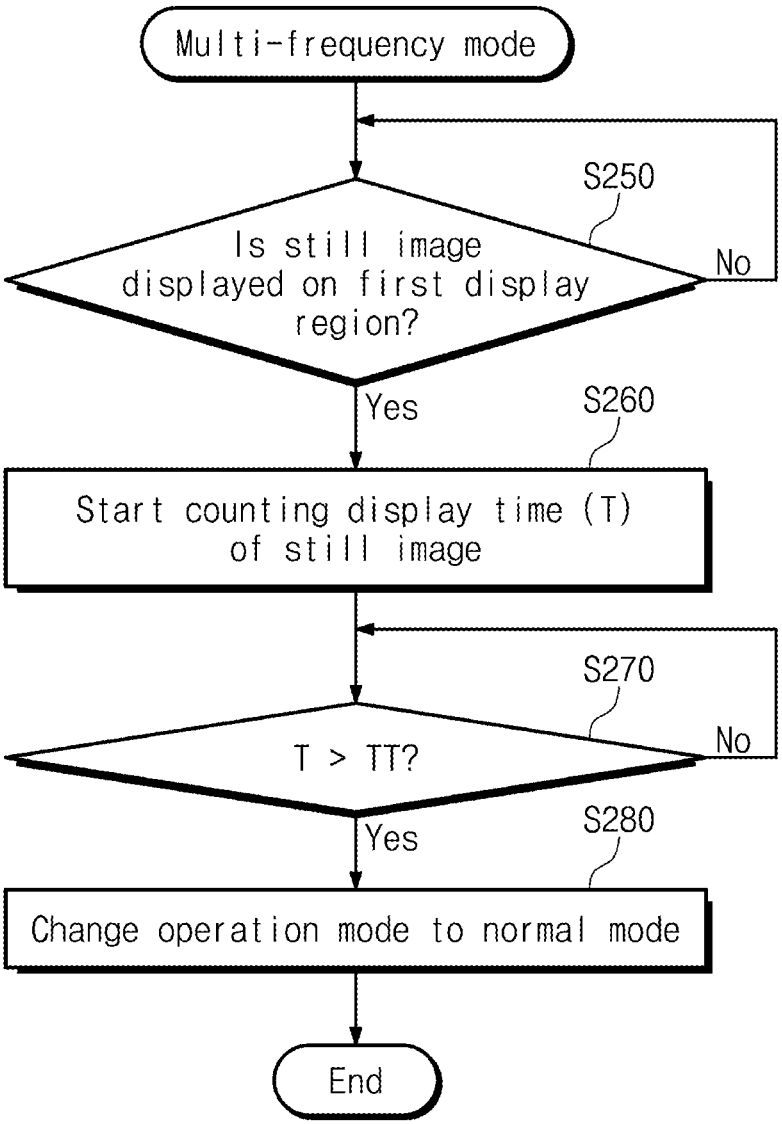
FIG. 12 is a flowchart showing an embodiment of the operation of a driving controller according to the invention in a multi-frequency mode.

FIG. 12 is a flowchart showing an embodiment of the operation of a driving controller according to the invention in a multi-frequency mode.

Referring to FIG. 8, FIG. 9, and FIG. 12, during a multi-frequency mode, the first display region DA1 may be driven at a first driving frequency, and the second display region DA2 may be driven at a second driving frequency lower than the first driving frequency.

The signal generator 120 may simultaneously display a moving image and a still image in the first display region DA1 in response to the image signal RGB and the control signal CTRL during a multi-frequency mode.

The frequency mode determination part 110 of the driving controller 100 determines whether a still image is displayed in the first display region DA1 in a multi-frequency mode (Operation S250). That is, the frequency mode determination part 110 determines whether the image signal RGB corresponding to the first display region DA1 includes both a moving image and a still image.

If, as illustrated in FIG. 9, the image signal RGB corresponding to the first display region DA1 includes both the first image IM1, which is a moving image, and the third image IM3, which is a still image, the frequency mode determination part 110 starts counting a display time T during which the third image IM3, which is a still image, is displayed (Operation S260). Although not illustrated in the drawings, the frequency mode determination part 110 may include a counter.

The frequency mode determination part 110 determines whether the display time T is longer than a predetermined reference time TT (or a threshold time) (Operation S270).

When the display time T is not longer than the predetermined reference time TT, the frequency mode determination part 110 maintains a multi-frequency mode. During the multi-frequency mode, the display time T of the third image IM3 which is a still image may continue to be counted.

When the display time T is longer than the predetermined reference time TT, the frequency mode determination part 110 changes the operation mode to a normal mode and outputs a mode signal MD corresponding to the normal mode (Operation S280).

After the third image IM3 which is a still image is displayed in the first display region DA1 driven at a first driving frequency for a long period of time (e.g., longer than the predetermined reference time TT) and the second image IM2 which is a still image is displayed in the second display region DA2 driven at a second driving frequency for a long period of time (e.g., longer than the predetermined reference time TT), a new image may be displayed in the first display region DA1 and the second display region DA2. In this case, there may be a difference in the degree of afterimage between the first and second display regions DA1 and DA2. When afterimages are shown differently in the first and second display regions DA1 and DA2, the afterimages may be visually recognized by a user more easily, and the boundary between the first and second display regions DA1 and DA2 may be visually recognized by the user. Therefore, when the display time T of a still image is longer than the predetermined reference time TT, the frequency mode determination part 110 changes the operation mode to a normal mode to drive the first and second display regions DA1 and DA2 at a normal frequency. As a result, the afterimage deviation between the first and second display regions DA1 and DA2 may be minimized, and the boundary between the first and second display regions DA1 and DA2 may be prevented from being visually recognized by the user.

Figure 13:
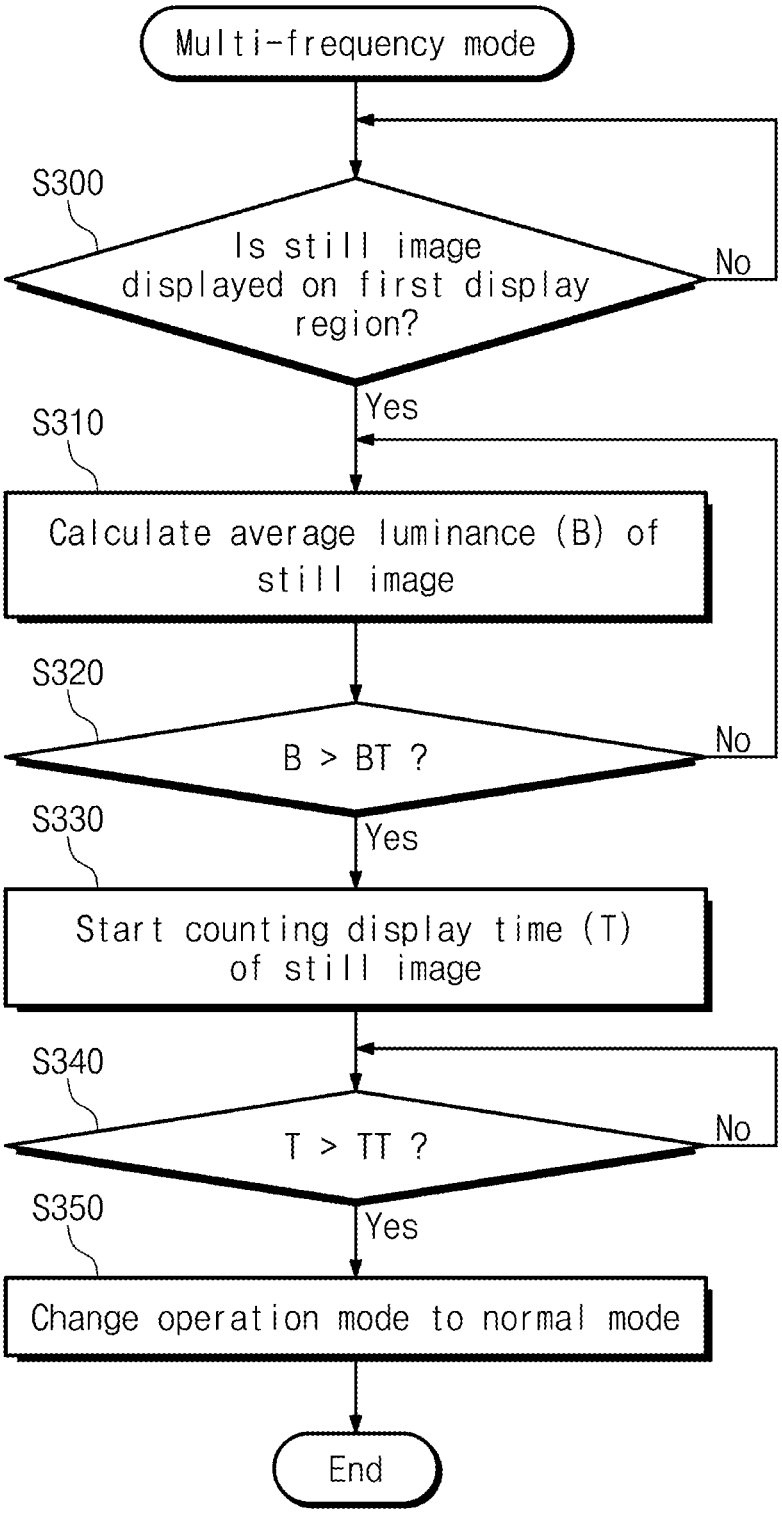
FIG. 13 is a flowchart showing an embodiment of the operation of a driving controller according to the invention in a multi-frequency mode.

FIG. 13 is a flowchart showing an embodiment of the operation of a driving controller according to the invention in a multi-frequency mode.

Referring to FIG. 8, FIG. 9, and FIG. 13, during a multi-frequency mode, the first display region DA1 may be driven at a first driving frequency, and the second display region DA2 may be driven at a second driving frequency lower than the first driving frequency.

The frequency mode determination part 110 of the driving controller 100 determines whether a still image is displayed in the first display region DA1 in a multi-frequency mode (Operation S300). That is, the frequency mode determination part 110 determines whether the image signal RGB corresponding to the first display region DA1 includes a still image.

When, as illustrated in FIG. 9, the image signal RGB corresponding to the first display region DA1 includes both the first image IM1, which is a moving image, and the third image IM3, which is a still image, the frequency mode determination part 110 calculates an average luminance B of the still image (Operation S310).

The frequency mode determination part 110 determines whether the average luminance B of a still image is higher than a reference luminance BT (or a threshold luminance) (Operation S320). In an embodiment, the average luminance B of the still image may be an average luminance of the third image IM3 displayed in the first display region DA1. In an embodiment, the average luminance B of the still image may be the average luminance of the third image IM3 displayed in the first display region DA1 and the second image IM2 displayed in the second display region DA2.

When the average luminance B of the still image is lower than the reference luminance BT, the frequency mode determination part 110 maintains the operation mode as the multi-frequency mode. When the average luminance B of the still image is lower than the reference luminance BT, even when the still image is displayed for a long period of time and then switched to a new image, the influence caused by an afterimage may not be significant. Therefore, when the average luminance B of the still image is lower than the reference luminance BT, the frequency mode determination part 110 maintains the multi-frequency mode. As a result, the second display region DA2 is driven at the second driving frequency, so that power consumption may be reduced.

When the average luminance B of the still image is higher than the reference luminance BT, the frequency mode determination part 110 starts counting a display time T during which the third image IM3, which is a still image, is displayed (Operation S330). Although not illustrated in the drawings, the frequency mode determination part 110 may include a counter.

The frequency mode determination part 110 determines whether the display time T is longer than a predetermined reference time TT (or a threshold time) (Operation S340).

When the display time T is not longer than the predetermined reference time TT, the frequency mode determination part 110 maintains a multi-frequency mode. During the multi-frequency mode, the display time T of the third image IM3 which is a still image may continue to be counted.

When the display time T is longer than the predetermined reference time TT, the frequency mode determination part 110 changes the operation mode to a normal mode and outputs a mode signal MD corresponding to the normal mode (Operation S350).

While the third image IM3, which is a still image, is displayed in the first display region DA1 driven at a first driving frequency, when the average luminance B of the still image is higher than the reference luminance BT and the display time T of the still image is longer than the predetermined reference time TT, the frequency mode determination part 110 changes the operation mode to a normal mode to drive the first and second display regions DA1 and DA2 at a normal frequency. As a result, the afterimage deviation between the first and second display regions DA1 and DA2 may be minimized, and the boundary between the first and second display regions DA1 and DA2 may be prevented from being visually recognized by the user.

Figure 14:
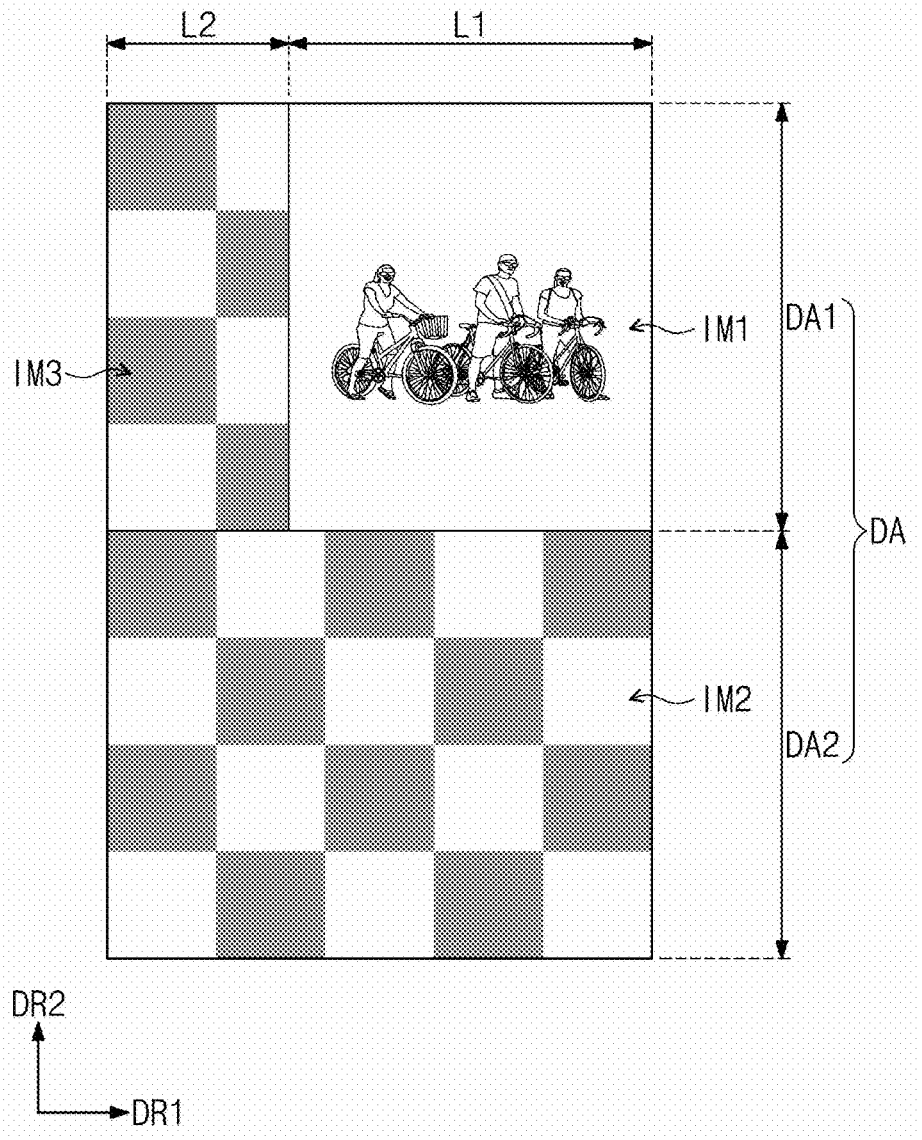
FIG. 14 is a view showing an image displayed on a display device.

FIG. 14 is a view showing an image displayed on a display device.

Referring to FIG. 14, the display region DA may include a first display region DA1 and a second display region DA2. The first image IM1 and a third image IM3 may be displayed in the first display region DA1, and the second image IM2 may be displayed in the second display region DA2. In an embodiment, the first image IM1 may be a moving image, and the second image IM2 and the third image IM3 may be still images. The second image IM2 and the third image IM3 may be images related to each other, or may be independent images.

In an example illustrated in FIG. 14, the second image IM2 and the third image IM3 may each be a worst pattern which causes an afterimage phenomenon when a new image is displayed after the second image IM2 and the third image IM3 have been displayed on the display device for a long period of time. In FIG. 14, in the second image IM2 and the third image IM3, regions having high luminance and regions having low luminance are arranged in a matrix form. The worst pattern causing the afterimage phenomenon is not limited to the example illustrated in FIG. 14. In an embodiment, a stripe pattern, a dot pattern, a zigzag pattern, and the like may be a worst pattern in which a region having high luminance and a region having low luminance are alternately disposed in the first direction DR1 or in the second direction DR2, for example. In an alternative embodiment, an image which has no predetermined shape but in which regions having high luminance and regions having low luminance appear randomly may be a worst pattern.

Figure 15:
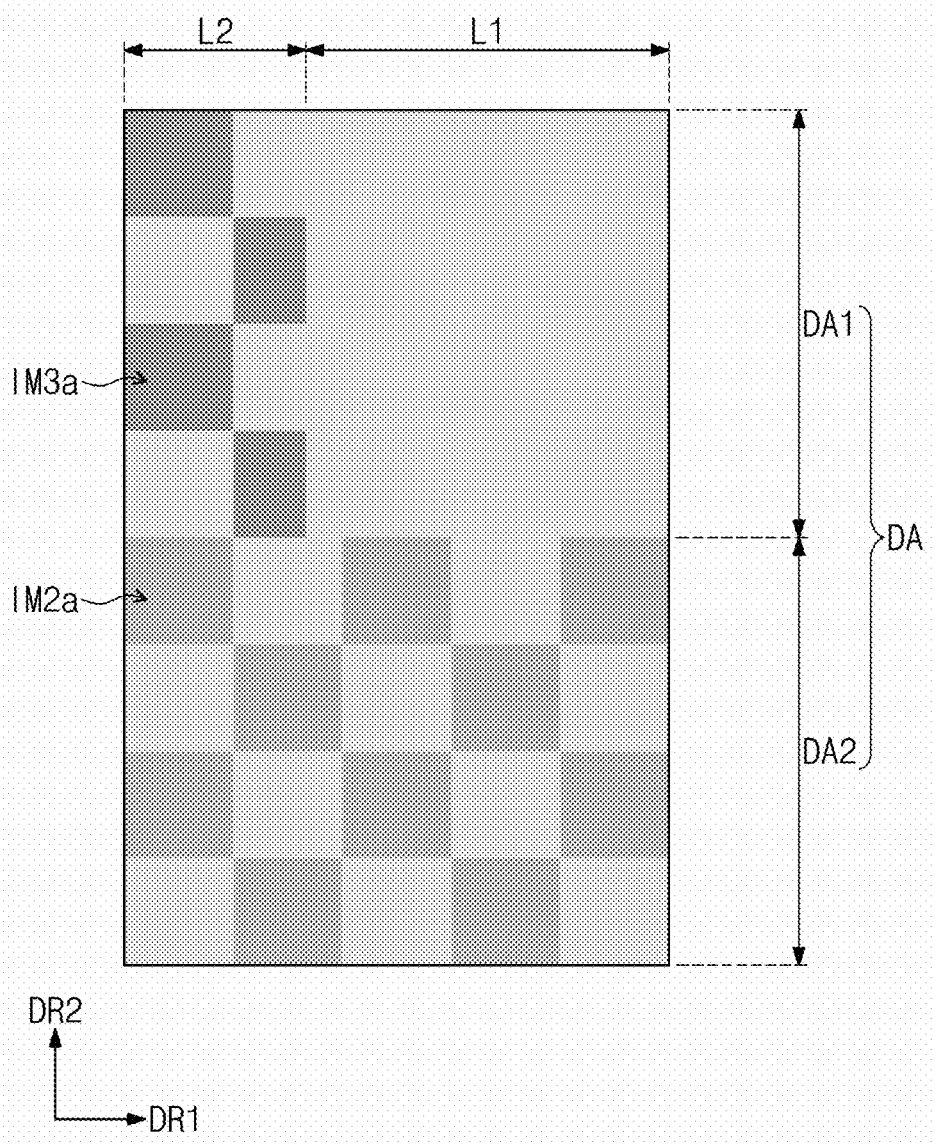
FIG. 15 is a view showing afterimage remaining on a display device after first to third images illustrated in FIG. 14 are displayed in a multi-frequency mode for a long time.

FIG. 15 is a view showing afterimage remaining on a display device after first to third images illustrated in FIG. 14 are displayed in a multi-frequency mode for a long time.

Referring to FIG. 14, and FIG. 15, in a multi-frequency mode, the first display region DA1 may be driven at a first driving frequency, and the second display region DA2 may be driven at a second driving frequency lower than the first driving frequency.

After the first to third images IM1, IM2, and IM3 illustrated in FIG. 14 are displayed in the display region DA in a multi-frequency mode for a long period of time, a new image (e.g., an image corresponding to gray scale for gray color) may be displayed in the entire display region DA as illustrated in FIG. 15.

Even though an image of the same gray scale (e.g., gray scale for gray color) is displayed in the entire display region DA, an afterimage IM3*a* by the third image IM3 (refer to FIG. 14) is displayed in the first display region DA1, and an afterimage IM2*a* by the second image IM2 (refer to FIG. 14) is displayed in the second display region DA2.

In FIG. 14, the second image IM2 and the third image IM3 are the same image patterns, but the afterimage IM3*a* shown in the first display region DA1 and the afterimage IM2*a* shown in the second display region DA2 are displayed to different luminance. This is because the driving frequency of the first display region DA1 and the driving frequency of the second display region DA2 are different in a multi-frequency mode. In other words, this means that even when a still image of the same gray scale is displayed in the first display region DA1 and the second display region DA2 for a long period of time, the effects of afterimages differ depending on the driving frequency.

Figure 16:
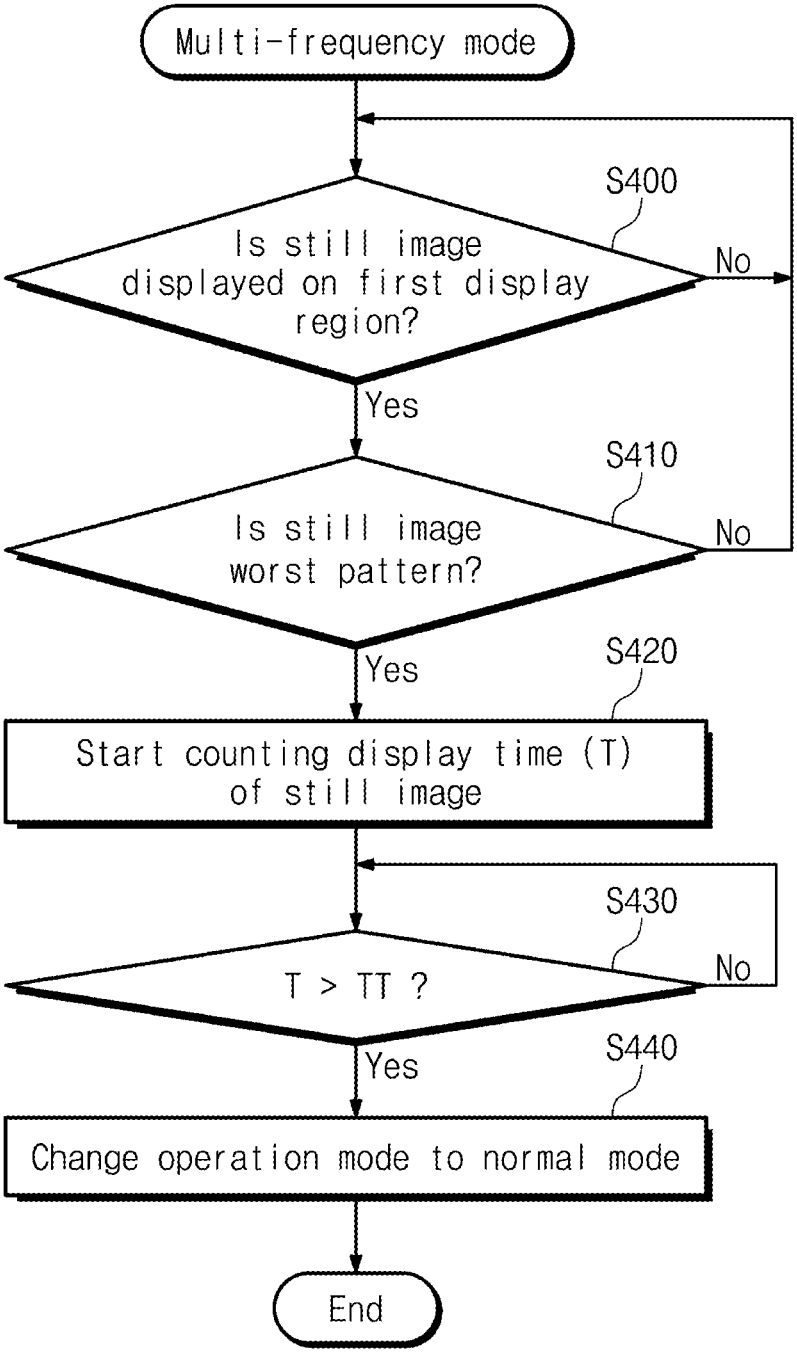
FIG. 16 is a flowchart showing an embodiment of the operation of a driving controller according to the invention in a multi-frequency mode.

FIG. 16 is a flowchart showing an embodiment of the operation of a driving controller according to the invention in a multi-frequency mode.

Referring to FIG. 8, FIG. 14, and FIG. 16, during a multi-frequency mode, the first display region DA1 may be driven at a first driving frequency, and the second display region DA2 may be driven at a second driving frequency lower than the first driving frequency.

The frequency mode determination part 110 of the driving controller 100 determines whether a still image is displayed in the first display region DA1 in a multi-frequency mode (Operation S400). That is, the frequency mode determination part 110 determines whether the image signal RGB corresponding to the first display region DA1 includes a still image.

If, as illustrated in FIG. 14, the image signal RGB corresponding to the first display region DA1 includes both the first image IM1, which is a moving image, and the third image IM3, which is a still image, the frequency mode determination part 110 determines whether the third image IM3, which is a still image, is a worst pattern (Operation S410).

As described above, when a still image to be displayed in the first display region DA1 corresponds to any one of predetermined patterns such as a matrix pattern, a stripe pattern, a dot pattern, and a zigzag pattern in which a region having high luminance and a region having low luminance are disposed, the frequency mode determination part 110 may determine that the still image to be displayed in the first display region DA1 is a worst pattern.

When the still image to be displayed in the first display region DA1 is not a worst pattern, the frequency mode determination part 110 maintains a multi-frequency mode.

When the still image to be displayed in the first display region DA1 is a worst pattern, the frequency mode determination part 110 starts counting a display time T during which the still image is displayed in the first display region DA1 (Operation S420). Although not illustrated in the drawings, the frequency mode determination part 110 may include a counter.

The frequency mode determination part 110 determines whether the display time T is longer than a predetermined reference time TT (or a threshold time) (Operation S430).

When the display time T is not longer than the predetermined reference time TT, the frequency mode determination part 110 maintains a multi-frequency mode. During the multi-frequency mode, the display time T of the third image IM3 which is a still image may continue to be counted.

When the display time T is longer than the predetermined reference time TT, the frequency mode determination part 110 changes the operation mode to a normal mode and outputs a mode signal MD corresponding to the normal mode (Operation S440).

After the third image IM3, which is a worst pattern, is displayed in the first display region DA1 driven at a first driving frequency for a long period of time (e.g., longer than the predetermined reference time TT) and the second image IM2, which is a still image, is displayed in the second display region DA2 driven at a second driving frequency for a long period of time (e.g., longer than the predetermined reference time TT), a new image may be displayed in the first display region DA1 and the second display region DA2. In this case, there may be a difference in the degree of afterimage between the first and second display regions DA1 and DA2. When afterimages are shown differently in the first and second display regions DA1 and DA2, the afterimages may be visually recognized by a user more easily, and the boundary between the first and second display regions DA1 and DA2 may be visually recognized by the user. Therefore, when the display time T of the third image IM3, which is a worst pattern, is longer than the predetermined reference time TT, the frequency mode determination part 110 changes the operation mode to a normal mode to drive the first and second display regions DA1 and DA2 at a normal frequency. As a result, the afterimage deviation between the first and second display regions DA1 and DA2 may be minimized, and the boundary between the first and second display regions DA1 and DA2 may be prevented from being visually recognized by the user.

Figure 17:
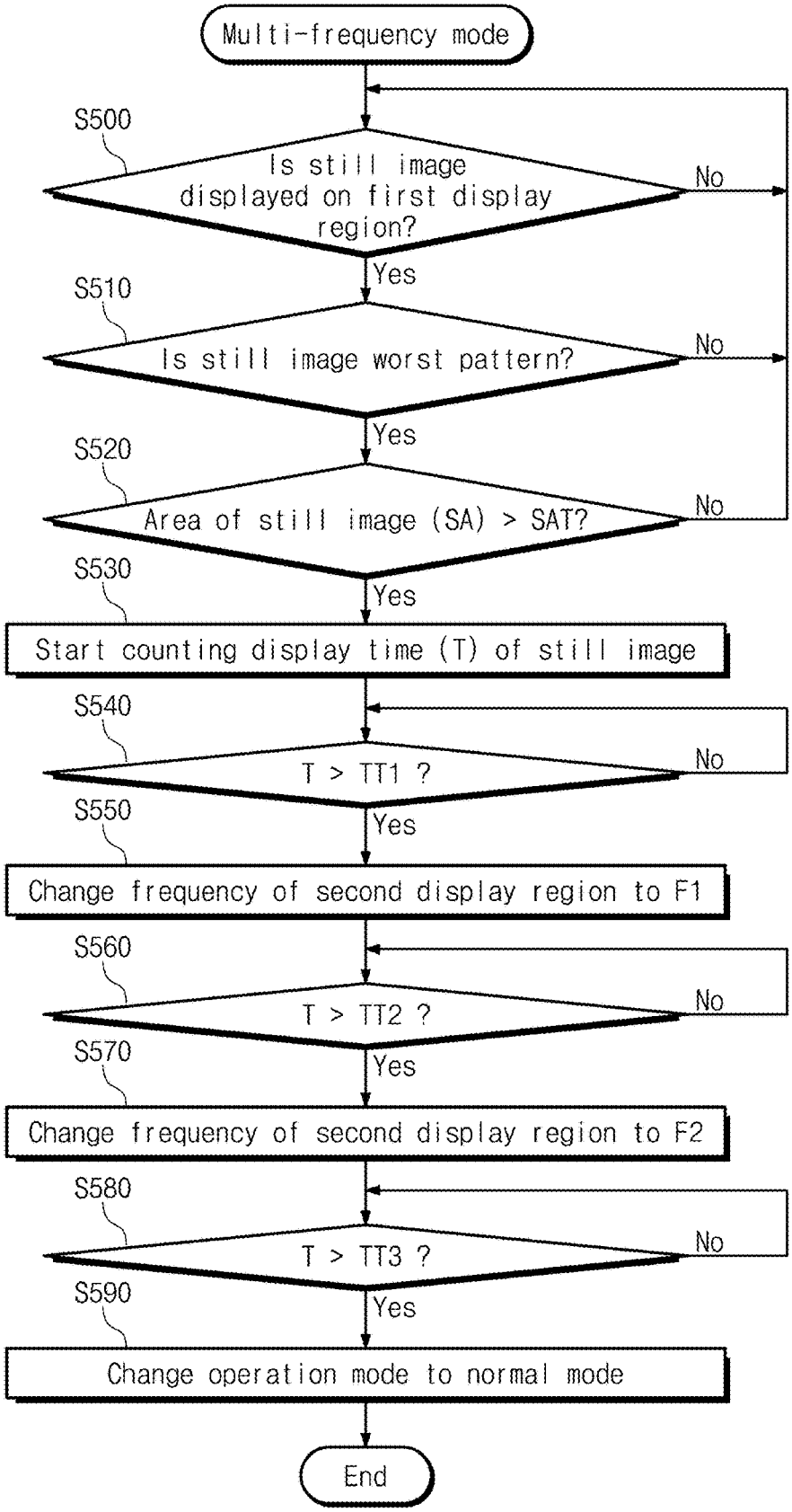
FIG. 17 is a flowchart showing an embodiment of the operation of a driving controller according to the invention in a multi-frequency mode.

FIG. 17 is a flowchart showing an embodiment of the operation of a driving controller according to the invention in a multi-frequency mode.

Referring to FIG. 8, FIG. 14, and FIG. 17, during a multi-frequency mode, the first display region DA1 may be driven at a first driving frequency, and the second display region DA2 may be driven at a second driving frequency lower than the first driving frequency.

The frequency mode determination part 110 of the driving controller 100 determines whether a still image is displayed in the first display region DA1 in a multi-frequency mode (Operation S500). That is, the frequency mode determination part 110 determines whether the image signal RGB corresponding to the first display region DA1 includes a still image.

When, as illustrated in FIG. 14, the image signal RGB corresponding to the first display region DA1 includes both the first image IM1, which is a moving image, and the third image IM3, which is a still image, the frequency mode determination part 110 determines whether the third image IM3, which is a still image, is a worst pattern (Operation S510).

As described above, when a still image to be displayed in the first display region DA1 corresponds to any one of predetermined patterns such as a matrix pattern, a stripe pattern, a dot pattern, and a zigzag pattern in which a region having high luminance and a region having low luminance are disposed, the frequency mode determination part 110 may determine that the still image to be displayed in the first display region DA1 is a worst pattern.

When the still image to be displayed in the first display region DA1 is not a worst pattern, the frequency mode determination part 110 maintains a multi-frequency mode.

When the still image to be displayed in the first display region DA1 is a worst pattern, the frequency mode determination part 110 compares the display area SA of the third image IM3 to be displayed in the first display region DA1 with a reference area SAT (Operation S520).

In an embodiment, when the ratio L2/(L1+L2) of a length L2 of the third image IM3 in the first direction DR1 to a length L1+L2 of the first display region DA1 in the first direction DR is equal to or greater than a predetermined value (⅓), the frequency mode determination part 110 may determine that the display area SA of the third image IM3 is greater than the reference area SAT, for example.

In an embodiment, when the ratio of the length of the third image IM3 in the first direction DR1 to the length of the first display region DA1 in the first direction DR1 is equal to or greater than a predetermined value, the frequency mode determination part 110 may determine that the display area SA of the third image IM3 is greater than the reference area SAT.

In an embodiment, when the length L2 of the third image IM3 in the first direction DR1 is greater than ½ of a length L1 of the first image IM1 in the first direction DR1, the frequency mode determination part 110 may determine that the display area SA of the third image IM3 is greater than the reference area SAT.

When the display area SA of the third image IM3 to be displayed in the first display region DA1 is less than the reference area SAT, the frequency mode determination part 110 maintains a multi-frequency mode.

When the display area SA of the third image IM3 to be displayed in the first display region DA1 is greater than the reference area SAT, the frequency mode determination part 110 starts counting a display time T during which a still image is displayed in the first display region DA1 (Operation S530). Although not illustrated in the drawings, the frequency mode determination part 110 may include a counter.

The frequency mode determination part 110 determines whether the display time T is longer than a predetermined first reference time TT1 (or a threshold time) (Operation S540).

When the display time T is not longer than the first reference time TT1, the frequency mode determination part 110 maintains a multi-frequency mode. During the multi-frequency mode, the display time T of the third image IM3 which is a still image may continue to be counted.

When the display time T is longer than the first reference time TT1, the frequency mode determination part 110 maintains the operation mode as a multi-frequency mode, but changes a second driving frequency of the second display region DA2 to a first intermediate frequency F1 and outputs a mode signal MD corresponding to the first intermediate frequency F1 (Operation S550). The first intermediate frequency F1 may be higher than an initial frequency of the second driving frequency. In an embodiment, the initial frequency of the second driving frequency may be about 1 Hz, and the first intermediate frequency F1 may be about 10 Hz, for example.

The frequency mode determination part 110 determines whether the display time T is longer than a predetermined second reference time TT2 (or a threshold time) (Operation S560). The second reference time TT2 may be greater than the first reference time TT1 (TT2>TT1).

When the display time T is not longer than the second reference time TT2, the frequency mode determination part 110 maintains a multi-frequency mode. During the multi-frequency mode, the display time T of the third image IM3 which is a still image may continue to be counted.

When the display time T is longer than the second reference time TT2, the frequency mode determination part 110 maintains the operation mode as a multi-frequency mode, but changes the second driving frequency of the second display region DA2 to a second intermediate frequency F2 and outputs a mode signal MD corresponding to the second intermediate frequency F2 (Operation S570). The second intermediate frequency F2 may be higher than the first intermediate frequency F1 of the second driving frequency. In an embodiment, a first intermediate frequency of the second driving frequency may be about 10 Hz, and the second intermediate frequency F2 may be about 30 Hz, for example.

The frequency mode determination part 110 determines whether the display time T is longer than a third reference time TT3 (or a threshold time) (Operation S580). The third reference time TT3 may be greater than the second reference time TT2, and the second reference time TT2 may be greater than the first reference time TT1 (TT3>TT2>TT1).

When the display time T is not longer than the third reference time TT3, the frequency mode determination part 110 maintains a multi-frequency mode. During the multi-frequency mode, the display time T of the third image IM3 which is a still image may continue to be counted.

When the display time T is longer than the third reference time TT3, the frequency mode determination part 110 changes the operation mode to a normal mode to drive the first and second display regions DA1 and DA2 at a normal frequency (Operation S590). As a result, the afterimage deviation between the first and second display regions DA1 and DA2 may be minimized, and the boundary between the first and second display regions DA1 and DA2 may be prevented from being visually recognized by the user.

Figure 18:
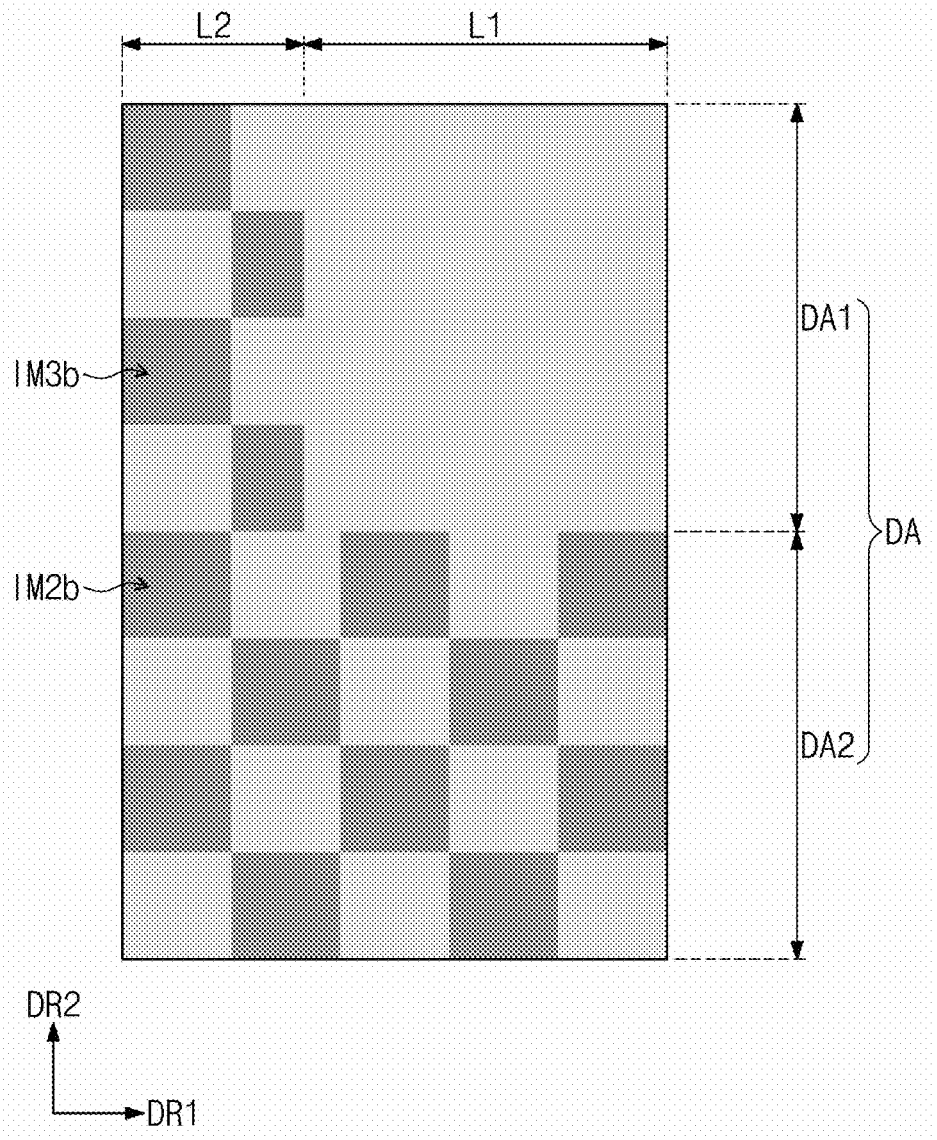
FIG. 18 is a view showing afterimage remaining on a display device after first to third images illustrated in FIG. 14 are displayed in a multi-frequency mode for a long time.

FIG. 18 is a view showing afterimage remaining on a display device after first to third images illustrated in FIG. 14 are displayed in a multi-frequency mode for a long time.

Referring to FIG. 14, and FIG. 18, in a multi-frequency mode, the first display region DA1 may be driven at a first driving frequency, and the second display region DA2 may be driven at a second driving frequency lower than the first driving frequency.

According to the time during which the first to third images IM1, IM2, and IM3 illustrated in FIG. 14 has been displayed in the first display region DA1 in the multi-frequency mode, the second driving frequency of the second display region DA2 may be determined. In an embodiment, as illustrated in FIG. 16, when the display time T of a still image is longer than the predetermined reference time TT in the multi-frequency mode, the operation mode is changed to a normal mode, for example. In an embodiment, as illustrated in FIG. 17, when the display time T of a still image is longer than the first to second reference time TT1 and TT2 in the multi-frequency mode, the second driving frequency of the second display region DA2 is sequentially changed to first and second intermediate frequencies F1 and F2, for example. In addition, when the display time T of a still image is longer than the third reference time TT3 in the multi-frequency mode, the operation mode is changed to a normal mode.

After the second image IM2 and the third image IM3 are displayed in the first and second display regions DA1 and DA2 for a long period of time, as illustrated in FIG. 18, a new image (e.g., an image corresponding to gray scale for gray color) may be displayed in the entire display region DA.

Even though an image of the same gray scale (e.g., gray scale for gray color) is displayed in the entire display region DA, an afterimage IM3*b* by the third image IM3 (refer to FIG. 14) is displayed in the first display region DA1, and an afterimage IM2*b* by the second image IM2 (refer to FIG. 14) is displayed in the second display region DA2.

The frequency mode determination part 110 in an embodiment may operate in the manner as shown in FIG. 16 and FIG. 17. In this case, as illustrated in FIG. 18, the afterimage IM3*b* shown in the first display region DA1 and the afterimage IM2*b* shown in the second display region DA2 may have the same luminance.

When images of the same gray scale are displayed in the first display region DA1 and the second display region DA2 for a long period of time, the afterimage IM3*b* shown in the first display region DA1 and the afterimage IM2*b* shown in the second display region DA2 have the same luminance, so that it is possible to minimize luminance deviations among regions.

When a moving image is displayed in a first display region and a still image is displayed in a second display region, a display device having the above configuration may be driven in a multi-frequency mode in which the first display region is driven at a first driving frequency and the second display region is driven at a second driving frequency. When a still image and a moving image are simultaneously displayed in the first display region in the multi-frequency mode, an operation mode may be changed to a normal mode depending on the characteristics and display time of the still image. Therefore, it is possible to minimize an afterimage deviation caused by the difference in driving frequency when the still image is displayed in a portion of the first display region and in the second display region for a long period of time.

Although the invention has been described with reference embodiments of the invention, it will be understood by those skilled in the art that various modifications and changes in form and details may be made therein without departing from the spirit and scope of the invention as set forth in the following claims. In addition, the embodiments disclosed in the invention are not intended to limit the technical spirit of the invention, and all technical concepts falling within the scope of the following claims and equivalents thereof are to be construed as being included in the scope of the invention.

What is claimed is:

1. A display device comprising:

a display panel including a plurality of pixels respectively connected to corresponding data lines of a plurality of data lines and corresponding scan lines of a plurality of scan lines;

a data driving circuit which drives the plurality of data lines;

a scan driving circuit which drives the plurality of scan lines; and a driving controller which controls the data driving circuit and the scan driving circuit such that the display panel is divided into a first display region and a second display region during a multi-frequency mode and the first display region and the second display region are respectively operated at first and second driving frequencies different from each other, wherein the driving controller changes an operation mode to a normal mode in which each of the first display region and the second display region is operated at a third frequency, when a still image and a moving image are simultaneously displayed in the first display region during the multi-frequency mode and a duration of the still image reaches a predetermined time.

2. The display device of claim 1, wherein the second driving frequency is lower than the first driving frequency during the multi-frequency mode.

3. The display device of claim 1, wherein the first driving frequency is identical to the third frequency.

4. The display device of claim 1, wherein the driving controller comprises:

a frequency mode determination part which determines the operation mode based on an image signal and a control signal and outputs a mode signal; and a signal generator which outputs a data control signal and a scan control signal corresponding to the mode signal, wherein the data control signal is provided to the data driving circuit, and the scan control signal is provided to the scan driving circuit.

5. The display device of claim 4, wherein the frequency mode determination part changes the operation mode such that the mode signal represents the normal mode when the still image and the moving image are simultaneously displayed in the first display region during the multi-frequency mode and the duration of the still image reaches the predetermined time.

6. The display device of claim 4, wherein the frequency mode determination part changes the operation mode such that the mode signal represents the normal mode when an average luminance of the still image displayed in the first display region is higher than a reference luminance.

7. The display device of claim 4, wherein the frequency mode determination part changes the operation mode such that the mode signal represents the normal mode when an average luminance of the still image displayed in the first display region is higher than a reference luminance and the duration of the still image reaches the predetermined time.

8. The display device of claim 4, wherein the frequency mode determination part changes the operation mode such that the mode signal represents the normal mode when the still image displayed in the first display region is a worst pattern and the duration of the still image reaches the predetermined time.

9. The display device of claim 4, wherein the frequency mode determination part changes the mode signal to indicate the normal mode according to the duration of the still image when the still image displayed in the first display region is a worst pattern and a display area of the still image is greater than a reference area.

10. The display device of claim 9, wherein the frequency mode determination part further:

changes a frequency of the second display region to a first intermediate frequency when the duration of the still image reaches a first reference time; and changes a frequency of the second display region to a second intermediate frequency when the duration of the still image reaches a second reference time, wherein the second reference time is greater than the first reference time, and the second intermediate frequency is higher than the first intermediate frequency.

11. The display device of claim 10, wherein the frequency mode determination part further changes the mode signal to indicate the normal mode when the duration of the still image reaches a third reference time, wherein the third reference time is greater than the second reference time.

12. The display device of claim 9, wherein the frequency mode determination part further determines that the display area of the still image is greater than the reference area when a ratio of a length of the still image in a first direction to a length of the first display region in the first direction is equal to or greater than a predetermined value.

13. A method for driving a display device, the method comprising:

dividing a display panel into a first display region and a second display region during a multi-frequency mode;

driving the first display region at a first driving frequency, and driving the second display region at a second driving frequency different from the first driving frequency;

determining whether a still image and a moving image are simultaneously displayed in the first display region; and changing an operation mode to a normal mode in which each of the first display region and the second display region is operated at a third frequency, when a duration of the still image reaches a predetermined time.

14. The method of claim 13, further comprising changing the operation mode to the normal mode when an average luminance of the still image displayed in the first display region is higher than a reference luminance.

15. The method of claim 13, wherein the changing the operation mode to the normal mode comprises:

determining whether an average luminance of the still image displayed in the first display region is higher than a reference luminance; and changing the operation mode to the normal mode when the average luminance of the still image is higher than the reference luminance and the duration of the still image reaches the predetermined time.

16. The method of claim 13, wherein the changing the operation mode to the normal mode comprises:

determining whether the still image displayed in the first display region is a worst pattern; and changing the operation mode to the normal mode when the duration of the still image reaches the predetermined time.

17. The method of claim 13, wherein the changing the operation mode to the normal mode comprises:

determining whether the still image displayed in the first display region is a worst pattern;

determining a display area of the still image is greater than a reference area; and changing the second driving frequency according to the duration of the still image when the still image displayed in the first display region is the worst pattern and the display area of the still image is greater than the reference area.

18. The method of claim 17, wherein the changing the second driving frequency comprises:

changing the second driving frequency to a first intermediate frequency when the duration of the still image reaches a first reference time; and changing the second driving frequency to a second intermediate frequency when the duration of the still image reaches a second reference time, wherein the second reference time is greater than the first reference time, and the second intermediate frequency is higher than the first intermediate frequency.

19. The method of claim 18, wherein the changing the operation mode to the normal mode comprises changing the operation mode to the normal mode when the duration of the still image reaches a third reference time, wherein the third reference time is greater than the second reference time.

20. The method of claim 17, wherein the changing the second driving frequency determines that the display area of the still image is greater than the reference area when a ratio of a length of the still image in a first direction to a length of the first display region in the first direction is equal to or greater than a predetermined value.

21. A method for driving a display device, the method comprising:

dividing a display panel into a first display region and a second display region during a multi-frequency mode;

driving the first display region at a first driving frequency and driving the second display region at a second driving frequency different from the first driving frequency;

displaying a still image and a moving image simultaneously in the first display region; and changing the second driving frequency of the second display region to a third frequency different from the second driving frequency when a duration of the still image reaches a predetermined time.

22. The method of claim 21, wherein the third frequency is identical to the first driving frequency.

* * * * *